US009164439B2

(12) United States Patent
Sato

(10) Patent No.: US 9,164,439 B2
(45) Date of Patent: Oct. 20, 2015

(54) FUSER CONTROL DEVICE AND IMAGE FORMING APPARATUS

(71) Applicant: Oki Data Corporation, Tokyo (JP)

(72) Inventor: Toshiki Sato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/225,925

(22) Filed: Mar. 26, 2014

(65) Prior Publication Data

US 2014/0294418 A1 Oct. 2, 2014

(30) Foreign Application Priority Data

Mar. 28, 2013 (JP) ..... 2013-069956

(51) Int. Cl.
*G03G 15/20* (2006.01)

(52) U.S. Cl.
CPC ..... *G03G 15/2042* (2013.01); *G03G 15/205* (2013.01); *G03G 15/2039* (2013.01)

(58) Field of Classification Search
CPC ..... G03G 15/2039; G03G 15/205; G03G 15/2042
See application file for complete search history.

(56) References Cited

U.S. PATENT DOCUMENTS

| | | | | |
|---|---|---|---|---|
| 2004/0086295 | A1 * | 5/2004 | Peng et al. | 399/69 |
| 2006/0177232 | A1 * | 8/2006 | Ehara et al. | 399/69 |
| 2007/0140719 | A1 * | 6/2007 | Sato | 399/69 |
| 2014/0369708 | A1 * | 12/2014 | Sato | 399/69 |

FOREIGN PATENT DOCUMENTS

| | | | |
|---|---|---|---|
| JP | H03-61978 | A | 3/1991 |
| JP | 2000-347531 | A | 12/2000 |
| JP | 2006-221139 | A | 8/2006 |
| JP | 2008-249763 | A | 10/2008 |
| JP | 2010-102210 | A | 5/2010 |
| JP | 2013-025045 | A | 2/2013 |

* cited by examiner

*Primary Examiner* — Ryan Walsh
(74) *Attorney, Agent, or Firm* — Muncy, Geissler, Olds & Lowe, P.C.

(57) ABSTRACT

A fuser control device includes a fuser device that a holding member holds configured to fuse a developing image to a priming medium, a fuser heater that is installed at the holding member configured to generate heat for at least a central part and side parts of a heat application roller, a first temperature detection part configured to detect a temperature of the fuser device and configured to transmit the temperature of the fuser device as a first detecting temperature, a second temperature detection part configured to detect a temperature of the holding member and configured to transmit the temperature of the holding member as a second detecting temperature, and a heat application control unit configured to control the temperature of the fuser device with changing a targeting temperature for the fuser device based on a controlling condition.

17 Claims, 25 Drawing Sheets

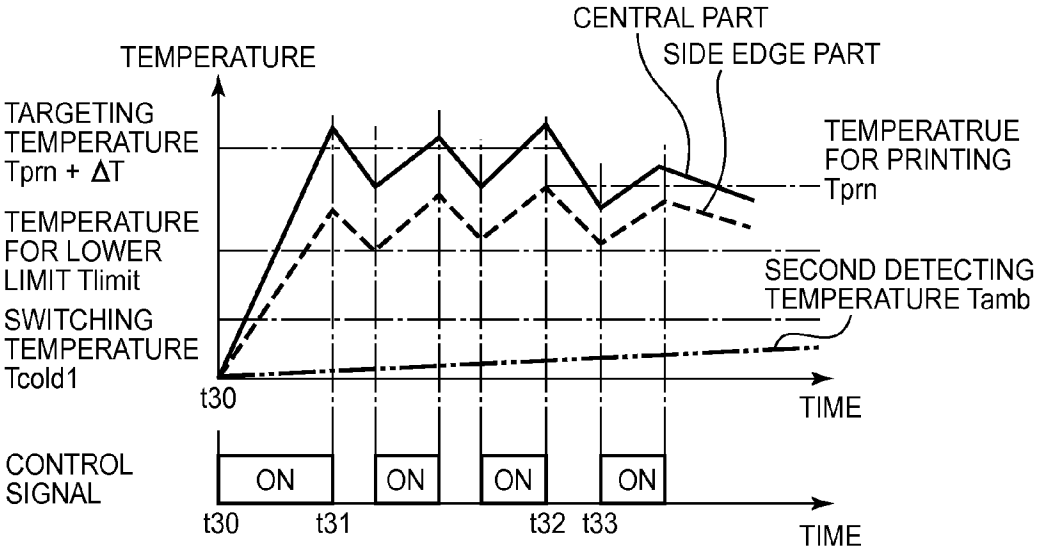
FIG. 16A
FIG. 16B
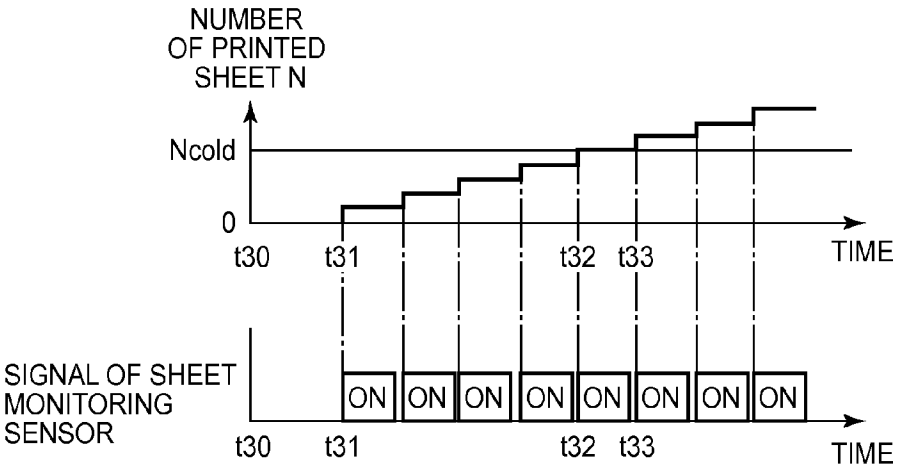
FIG. 16C
FIG. 16D

FUSER CONTROL DEVICE AND IMAGE FORMING APPARATUS

CROSS-REFERENCE TO RELATED APPLICATION

This application claims priority under 35 U.S.C. §119 from Japanese Patent Application No. P 2013-069956, filed on Mar. 28, 2013, the disclosure of which is incorporated herein by reference.

BACKGROUND

1. Technical Field

This application relates to a fuser control device and an image forming apparatus.

2. Description of Related Art

Electrophotographic printers conventionally transfer toner corresponding to printing images onto a paper and fix the toner that is transferred to the paper with application of heat and pressure. Japanese patent publication 2008-249763 describes a fuser control device and an image forming apparatus used in such an electrophotographic printer that are arranged with plural heaters and plural temperature detectors, which are disposed at different places in a longitudinal direction of a fuser device.

However, in other conventional devices, the fuser control device and the image forming apparatus have problems described hereafter. When a printing is started in a situation that a temperature of the fuser control device and the image forming apparatus is the same as a room temperature, edges of the fuser device that are closer to the fuser device underheat and it is difficult to properly fuse the toner image to the sheet, because a temperature of a holding member that holds the fuser device is low and a heat capacity of the holding member is large. Further, there is a way to set a high temperature of the fuser device preliminarily to improve the aforementioned problem, but the consumed power substantially increases.

SUMMARY

In view of the above, an image forming apparatus is disclosed.

In particular, a fuser control device, according to an embodiment, includes a fuser device that a holding member holds and is configured to fuse a developing image to a printing medium, a fuser heater that is installed at the holding member and is configured to generate heat for at least a central part and side parts of a heat application roller, a first temperature detection part configured to detect a temperature of the fuser device and configured to transmit the temperature of the fuser device as a first detecting temperature, a second temperature detection part configured to detect a temperature of the holding member and configured to transmit the temperature of the holding member as a second detecting temperature and a heat application control unit configured to control the temperature of the fuser device by changing a targeting temperature for the fuser device based on a controlling condition, wherein an amount of heat generation and a second detecting temperature.

BRIEF DESCRIPTION OF THE DRAWINGS

FIGS. 16A-16D are schematic views showing a control system and process of a temperature of the fuser device from FIG. 13;

DETAILED DESCRIPTION

Figure 1:
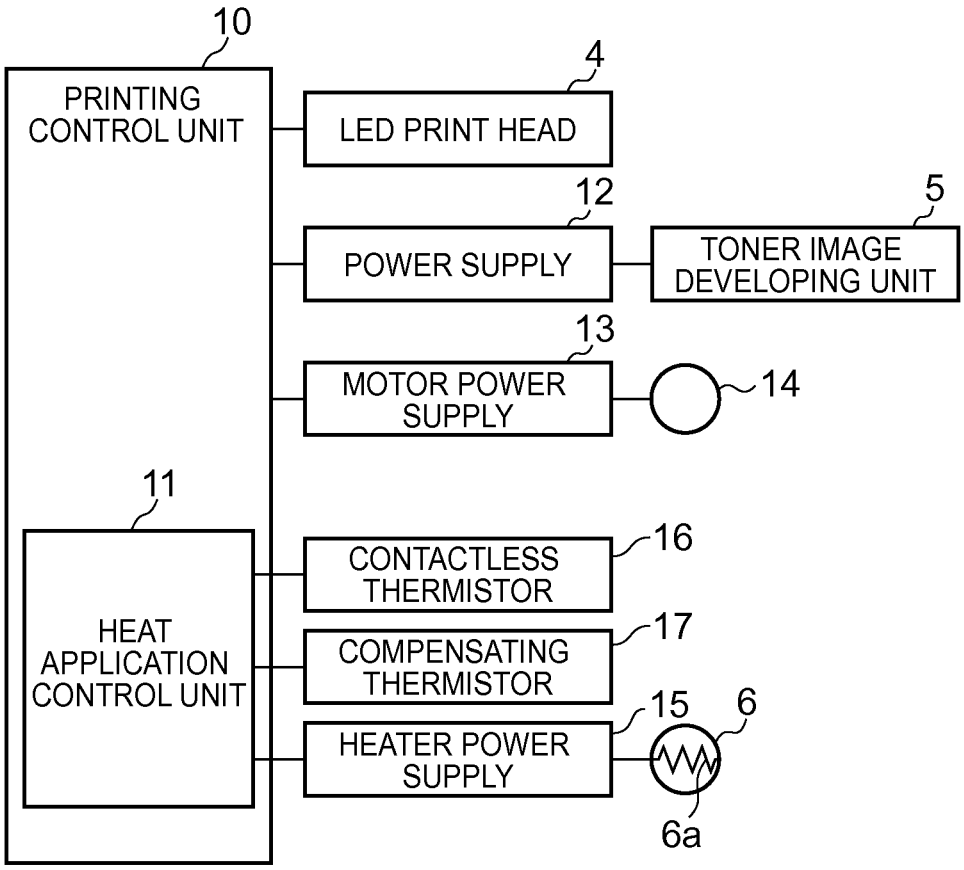
FIG. 1 is a block diagram showing an image forming apparatus according to an exemplary embodiment of the present application.

Exemplary embodiments of an image forming apparatus will be described with reference to FIGS. 1 to 25C of the drawings. In the drawings, configurations, positional relations, dimensions, and alignments of elements of the device are illustrated generally for understanding the embodiments and are only intended to facilitate understanding. Described numerical values are merely exemplary. In the drawings, common elements of structures may be designated by the same reference characters, and an explanation thereof is occasionally omitted. Accordingly, the described embodiments are not limiting and can be combined with one another.

Figure 2:
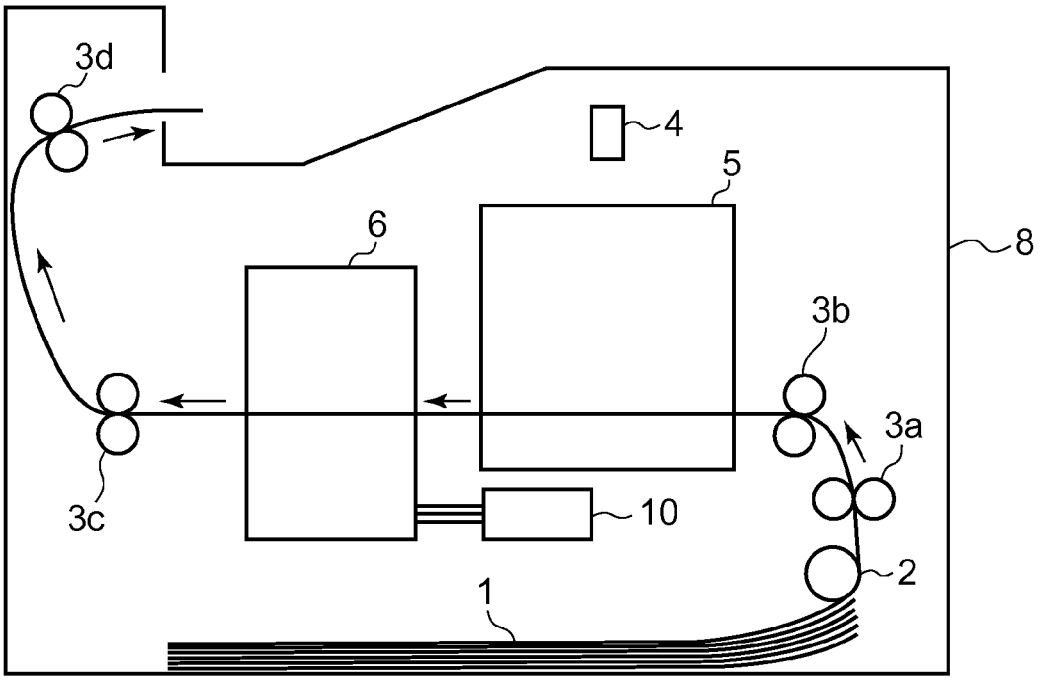
FIG. 2 is a schematic sectional view showing the image forming apparatus.

An image forming apparatus according to an exemplary embodiment is described below. The image forming apparatus is an apparatus that forms image on a sheet by using a developer in an electrographic system, whereby the apparatus can be a printer. The image forming apparatus, as illustrated in FIG. 2, includes a hopping roller 2, sheet carrying paths 3*a*-3*d*, an LED print head 4 (i.e., an exposure unit), a toner image developing unit 5, a fuser device 6, and a house 8. The hopping roller 2 feeds the sheet 1 to the sheet carrying path 3. The LED print head 4 is provided adjacent to the toner image developing unit 5, and configured to emit light to form a latent image. The fuser device 6 is configured to fix the toner image (having been transferred to the sheet 1) to the sheet 1. The hopping roller 2, the toner image developing unit 5, and the fuser device 6 are arranged in this order.

The image forming apparatus includes a printing control unit 10 that controls general operations of the printing, and the printing control unit 10 includes a heat application control unit 11 that controls temperature of the fuser device 6.

The printing control unit 10 connects the LED print head 4, a power supply 12, and motor power supply 13. The power supply 12 supplies power to the toner image developing unit 5.

Figure 9:
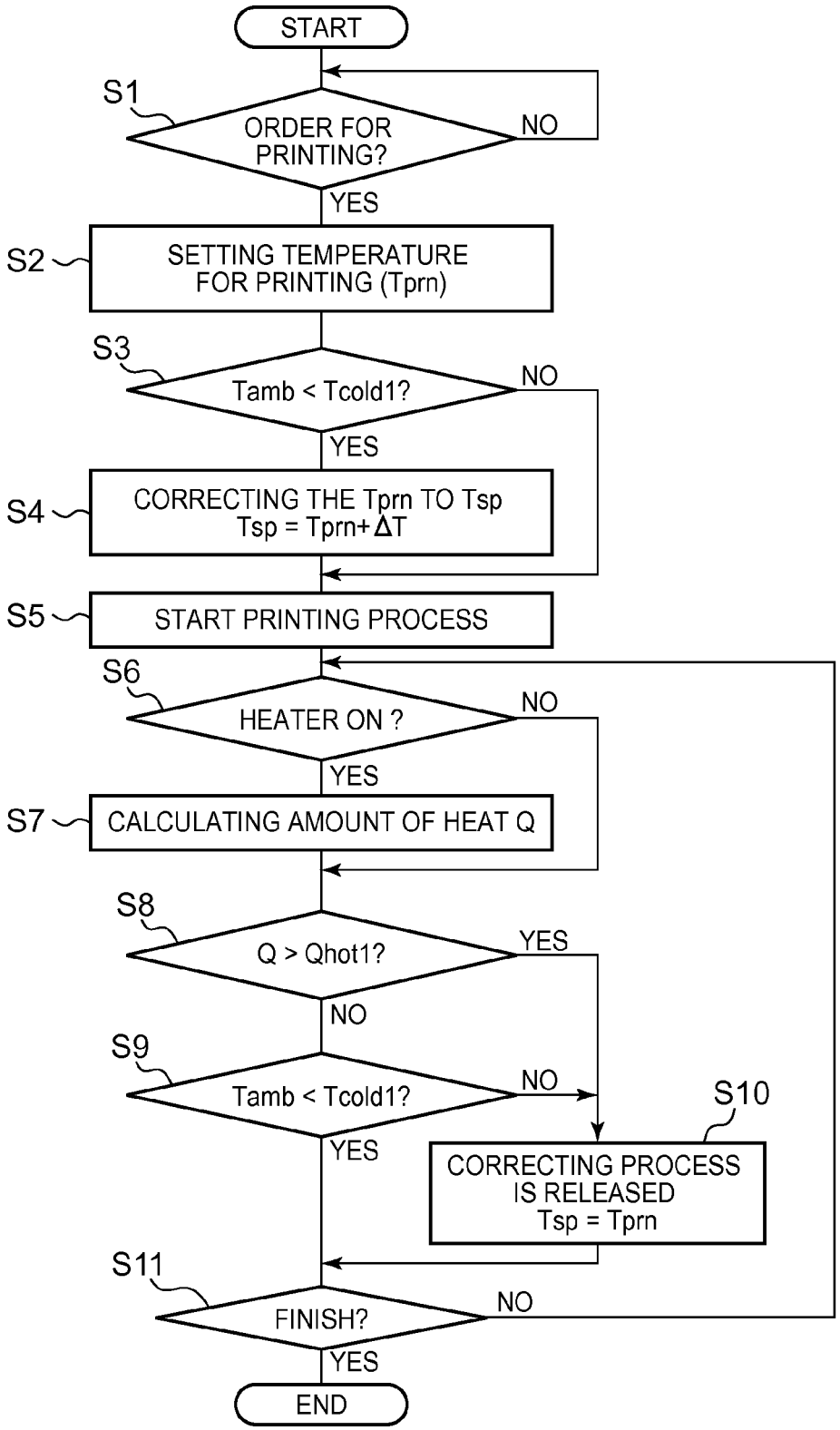
FIG. 9 is a flowchart showing a control operation for a temperature of the fuser device from FIG. 1.

The heat application control unit 11 controls a heater power supply 15 to increase or decrease a temperature based on a result of a detected temperature of the fuser device 6. Besides, the heat application control unit 11 controls temperature of the fuser device 6 based on a controlling condition for controlling the temperature of the fuser device 6. The controlling condition is described in FIGS. 9, 11, and 12, etc. For example, the controlling condition is that a second detecting temperature Tamb is lower or higher than a switching temperature Tcold1 (FIG. 9, S3). So, the heat application control unit 11 changes a targeting temperature Tsp of the fuser device 6 when the second detecting temperature Tamb is lower than the switching temperature Tcold1 (FIG. 9, S3 and S4). The fuser device 6 includes a fuser heater 6*a* as a heat application unit, and the heater power supply 15 supplies power to the fuser heater 6*a*. The heat application control unit 11 is connected to the heater power supply 15, a contactless thermistor 16, and a compensating thermistor 17 (FIG. 1). The contactless thermistor 16 detects a temperature of the fuser device 6, and outputs a first detecting temperature to the heat application control unit 11 as a first detecting temperature unit. The compensating thermistor 17 detects a temperature of a holding member that holds the contactless thermistor 16, and outputs a second detecting temperature to the heat application control unit 11 as a second detecting temperature unit.

The fuser control device may include the heat application control unit 11, the heater power supply 15, a fuser heater 6*a*, the fuser device 6, the contactless thermistor 16, and the compensating thermistor 17. A heat application control device may be comprised of the heat application control unit 11 and the heater power supply 15.

Figure 3:
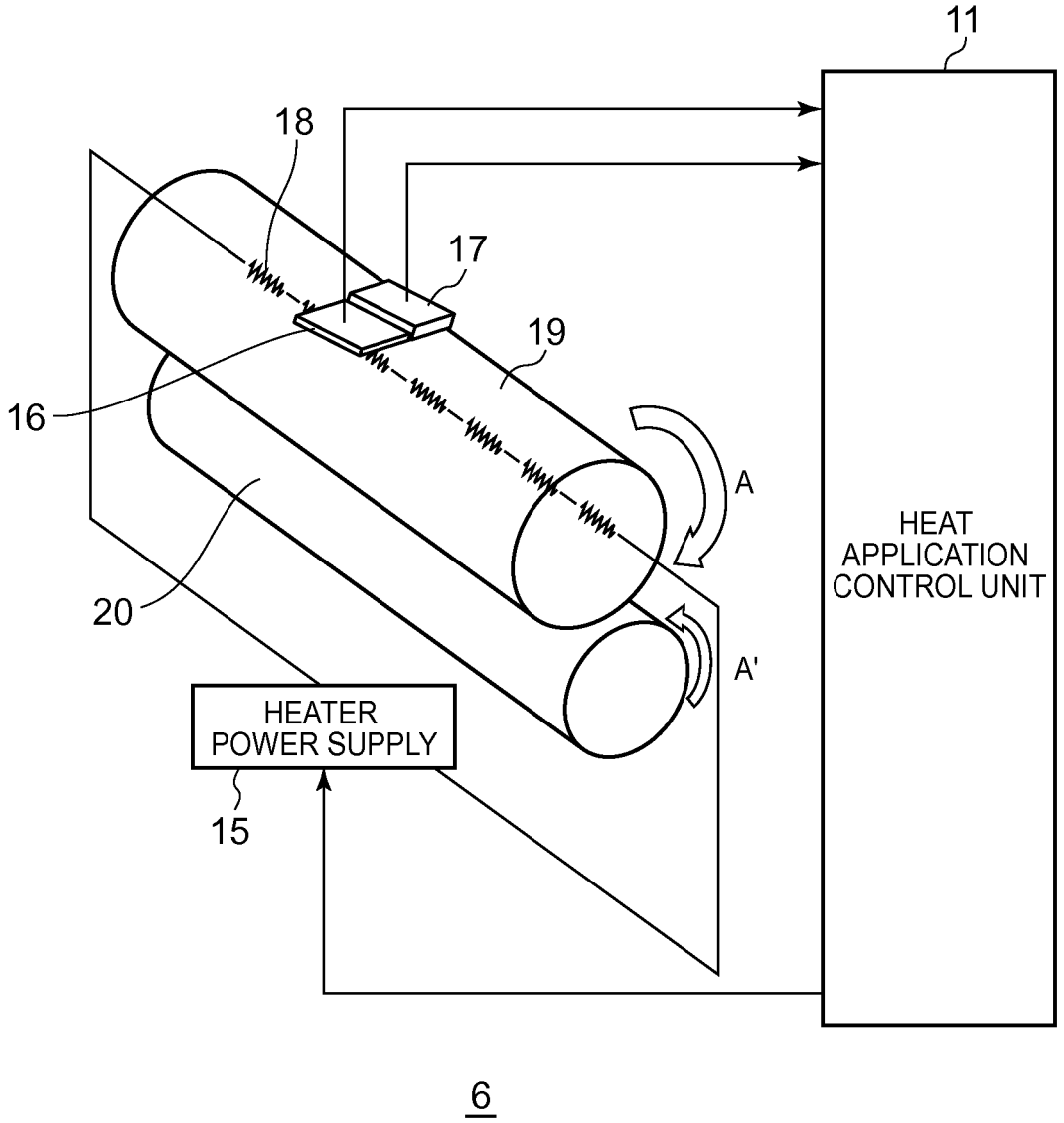
FIG. 3 is a perspective view showing a control system of a temperature of a fuser device from FIG. 2.

As shown in FIG. 3, the fuser device 6 includes a heat application roller 19, a halogen heater 18 as the fuser heater 6*a*, a pressure application roller 20, the contactless thermistor 16, and the compensating thermistor 17. The heat application roller 19 as a heat application member heats and carries the sheet 1. The halogen heater 18 is arranged in a contactless manner within the heat application roller 19 and heats the heat application roller 19. As described above, the halogen heater 18 is arranged in a contactless manner, but the halogen heater 18 might be arranged in a contact manner. The pressure application roller 20 as a pressure application member contacts the heat application roller 19, and presses the sheet 1 in a direction towards the heat application roller 19.

The contactless thermistor 16 and the compensating thermistor 17 output the first detecting temperature Tnc and the second detecting temperature Tamb to the heat application control unit 11. The heat application control unit 11 outputs a control signal to the heater power supply 15. The heat application control unit 11 calculates a temperature of the heat application roller 19 based on the first detecting temperature Tnc and the second detecting temperature Tamb, and outputs a control signal so as to keep a set or predetermined temperature of the heat application roller 19. The heater power supply 15 controls a power supply for the halogen heater 18 based on the control signal.

The heat application control unit 11 contactlessly detects a surface temperature of the heat application roller 19 based on the first detecting temperature Tnc and the second detecting temperature Tamb. The surface temperature Tc is described below in expression (1).

$$Tc=\alpha*(Tnc-Tamb)+Tamb \quad (1)$$

In the expression (1), Tc is a surface temperature of the heat application roller 19, and $\alpha$ is a coefficient that is calculated by an experiment. For example, $\alpha$ can be 1.2.

When Tnc is 150 degrees C., Tamb is 30 degrees C., and $\alpha$ is 1.2, the surface temperature Tc is calculated below.

$$Tc=1.2*(150-30)+30=174 \text{ degrees C.}$$

Figure 4:
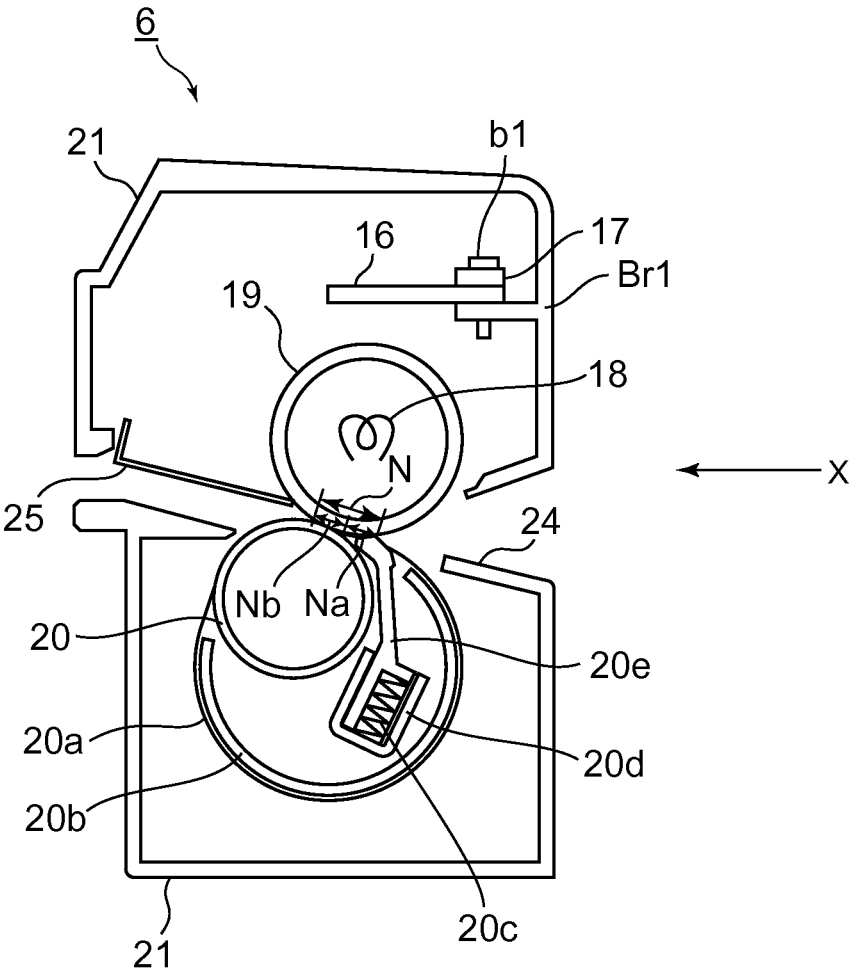
FIG. 4 is a sectional view showing the fuser device for a belt-type.

As shown in FIG. 4, the fuser device 6 includes the heat application roller 19, the pressure application roller 20, a fuser belt 20*a*, and a pressure application pad 20*e*. The pressure application pad 20*e* as a pressure application member holds and presses the sheet 1 towards the heat application roller 19. The fuser belt 20*a* suspends the pressure application roller 20 and the pressure application pad 20*e*, and is rotated by the heat application roller 19.

The heat application roller 19 includes a cored bar as a substrate. The cored bar can be an aluminum tube, and an external diameter, i.e., an outer circumference, of the heat application roller 19 may be 30 mm. The heat application roller 19 is connected to a drive motor (not shown) via a gear (not shown), and rotates via drive power generated by the drive motor. The pressure application roller 20 is pressed by a spring (not shown) in a direction towards the heat application roller 19 that the pressure application roller 20 contacts and presses. The pressure application pad 20*e* is pressed by a spring 20*c* in a direction towards the heat application roller 19 that the pressure application pad 20*e* contacts and presses. The pressure application roller 20 contacts the heat application roller 19, and nipping parts Na and Nb are generated by the contact (FIG. 4).

The contactless thermistor 16 and the compensating thermistor 17 constitute a unit as a detecting temperature unit. The contactless thermistor 16 and the compensating thermistor 17 are held with a screw b1 at a projecting part Br1, and the contactless thermistor 16 can be spaced from the heat application roller 19.

The compensating thermistor 17 detects a temperature of the projecting part Br1. The heat application control unit 11 calculates an amount of heat transfer as the surface temperature of the heat application roller 19 based on the first detecting temperature Tnc and the second detecting temperature Tamb.

The contactless thermistor 16 and the compensating thermistor 17 are a device whose resistance value changes depending on a temperature. The heat application control unit 11 detects the temperature of the contactless thermistor 16 and the compensating thermistor 17 when the heat application control unit 11 detects the resistance value. The character of the device is that the resistance value decreases with increasing of the temperature.

The pressure application roller 20 and the pressure application pad 20*e* are arranged inside the fuser belt 20*a* so as to press towards the heat application roller 19 via the fuser belt 20*a*. If the element (contactless thermistor 16 to separator plate 25) locates relatively in a right side, the element locates in an upstream side (FIG. 4). As shown in FIG. 4, the pressure application roller 20 is located relatively in a left side of the pressure application pad 20*e* compared with the pressure application pad 20*e*. So, the pressure application pad 20*e* locates in an upstream side. A biased power to the pressure application pad 20*e* by the spring 20*c* and a biased power to the pressure application roller 20 by the spring (not shown) make the nipping parts Na, Nb.

The pressure application pad 20*e* moves along a pressure application pad guide 20*d* that is arranged in the holding member 21. The pressure application pad 20*e* presses the heat application roller 19 with the spring 20*c* whose one edge is installed at the pressure application pad guide 20*d*.

The fuser belt 20*a* is made of a film that has a base layer and a release layer on the base layer. The base layer is formed of a polyimide. The heat application roller 19 and the pressure application roller 20 nip the fuser belt 20*a*, and the nipping part Na is formed. Also, the heat application roller 19 and the pressure application pad 20*e* nip the fuser belt 20*a*, and the nipping part Nb is formed.

When the nipping parts Na, Nb are formed, the sheet 1 carried through the fuser device 6 obtains more heat compared with one nipping part. As a result, a temperature of the fuser device 6 may decrease more quickly.

A pressure by the pressure application roller 20 to the heat application roller 19 at the nipping part Nb is constitutionally larger than a pressure by the pressure application pad 20*e* to the heat application roller 19 at the nipping part Na. The pressure to a toner as the developer at the nipping part Nb where is an exit side of the sheet 1 is larger than the pressure at the nipping part Na on an entrance side.

Toner has a characteristic that a melting rate depends on a temperature. If a temperature is high, the melting rate is fast. The toner on the sheet 1 when it passes through at the nipping part Na is not fully heated. Thus, the melting of the toner comes short at the nipping part Na. On the other hand, the toner on the sheet 1 when it passes through at the nipping part Nb is fully heated. Thus, the melting of the toner lasts at the nipping part Nb.

As shown in FIG. 4, the holding member 21 includes a sheet guide 24. The sheet guide 24 guides a sheet 1 that carries from the toner image developing unit 5. The separator plate 25 is a separation pawl to separate a sheet 1 that sticks to the heat application roller 19, and is arranged at an area close to the heat application roller 19.

Figure 5:
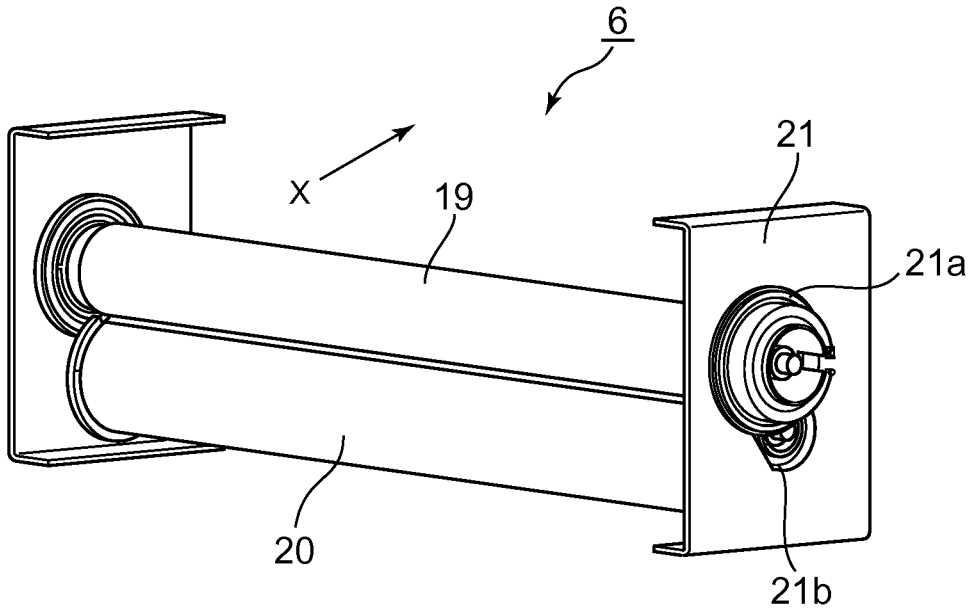
FIG. 5 is a perspective view showing a heat application roller and a pressure application roller from FIG. 4.

As shown in FIG. 5, ball bearings 21*a* is arranged at both side edges of the heat application roller 19, and one of the edges includes a driving gear that is fixed by a retaining ring (not shown). The driving gear connects a driving motor for the fuser device 6 that the printing control unit 10 controls. The holding member 21 holds the halogen heater 18 that is built-in by the heat application roller 19.

The pressure application roller 20 has a cored bar and an elastic layer. The cored bar may be a metal, for example, iron, and the cored bar may be a hollow pipe. The elastic layer formed on the cored bar, has a character of heat-resisting, and is made from a silicone rubber. A part of a radiant heat to the heat application roller 19 from the halogen heater 18 transfers to the case via the holding member 21. The case needs to be robust to ensure strength of it, so a heat capacity of the case is much larger than the heat application roller 19.

Figure 6A:
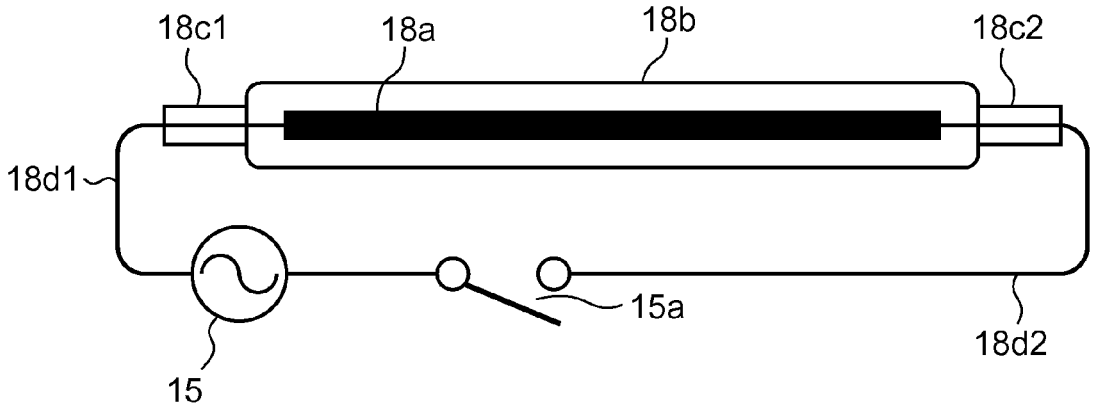
FIG. 6A is a schematic view showing a halogen heater from FIG. 3.

As shown in FIG. 6A, the halogen heater 18 includes a filament 18*a*, a glass tube 18*b*, and insulations 18*c*1, 18*c*2. The filament 18*a* as a heating element is, for example, a tungsten. The glass tube 18*b* holds the filament 18*a*. The insulations 18*c*1, 18*c*2 sever electrical connections with the holding member 21, and the insulations 18*c*1, 18*c*2 is arranged at the both side edges of the holding member 21. For example, an inactive gas, a bromine, and a chlorine that are in an organohalide situation are tubed in the glass tube 18*b*. The inactive gas may be, for example, argon, krypton, etc.

The halogen heater 18 supplies and stops power to the filament 18*a* repeatedly, so the gas in the glass tube 18*b* is heated and is cooled over and over again periodically. The period is a halogen-cycle between a halogen and a tungsten here. The halogen heater 18 heats in a way to generate the halogen-cycle until the end in a life of the fuser device 6.

The halogen heater 18 connects the heater power supply 15 with heater lines 18*d*1, 18*d*2, and the heater power supply 15 has a switch 15*a* built-in. The switch 15*a* switches supplying and stopping an alternate power to the filament 18*a*.

The switch 15*a* switches ON or OFF states of an electrical conduction based on a control signal from the heat application control unit 11. The switch 15*a* consists of a semiconducting switch that applies a high current. The semiconducting switch is, for example, triac-driven switch. When the switch 15*a* has the ON state, the filament 18*a* generates heat with the current that the heater power supply 15 supplies. On the other hand, when the switch 15*a* has the OFF state, the filament 18*a* stops generating heat.

As described above, the power from the heater power supply 15 transfers to the filament 18*a*, and the filament 18*a* generates heat with the power. The glass tube 18*b* is transparent, it transfers and radiates the generated heat to the inside of the cored bar of the heat application roller 19. An output voltage of the heater power supply 15 is, for example, AC 100V, and a consumed power is, for example, 1200 W.

Figure 6B:
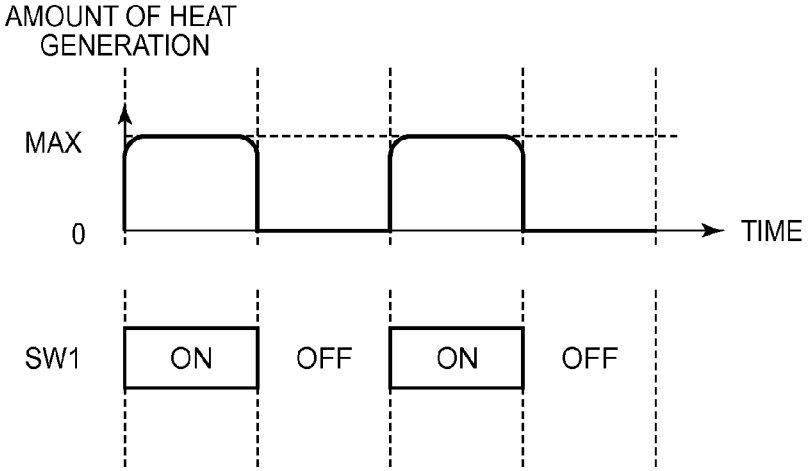
FIG. 6B is a schematic view showing a way to heat for the halogen heater from FIG. 3.

A relation between the ON/OFF situation of the switch 15*a* and the amount of heat generation of the filament 18*a* is described in FIGS. 6A-6B. When the ON/OFF situation is managed, a time for heat generation is managed. The managing of the time for heat generation is to manage the amount of heat generation.

Figure 7A:
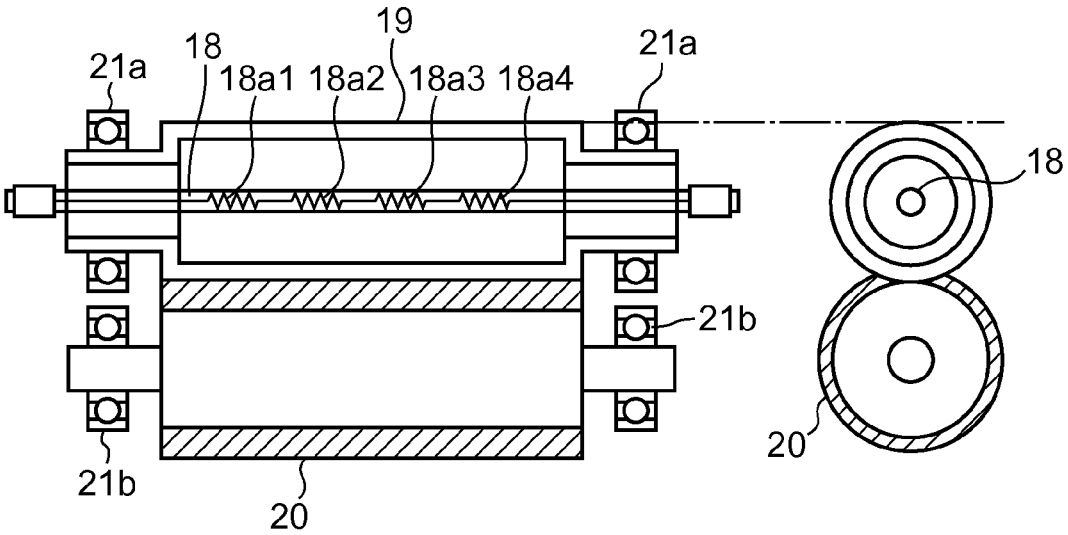
FIG. 7A is a schematic view showing the fuser device.
Figure 7B:
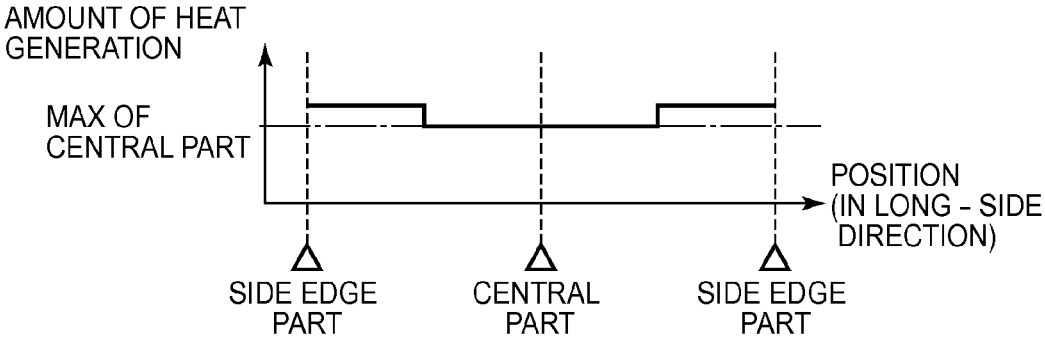
FIG. 7B is a schematic view showing a distribution of amount of heat generation.

FIG. 7A describes a constitution of the heat application roller 19 that has the halogen heater 18 built-in, and FIG. 7B describes a distribution of amount of heat generation by the halogen heater 18 in the long-side direction.

The heat application roller 19 needs to hold and carry the sheet 1 with the pressure application roller 20. Both side edges of the heat application roller 19 and the pressure application roller 20 include ball bearings 21*a* and ball bearings 21*b* so as to rotate for the heat application roller 19 and the pressure application roller 20. A part of the heat that is radiated from the halogen heater 18 to the heat application roller 19 transfers to the house 8 via the ball bearings 21*a* and the holding member 21. The house 8 needs to be robust to be required strong. Thus, the heat capacity of the house 8 is greater than the heat application roller 19.

For example, the heat application roller 19 begins heating from a situation that the temperature of the fuser device 6 is same to a temperature of a room. Next, when the temperature of a center part of the heat application roller 19 increases very much, the temperature of both side edges of the heat application roller 19 may not increase as high as the temperature of the center part due to the transferring heat to the house 8. As a result, a deficiency in fusing may happen. To curb the deficiency in fusing, a resistance value of the filament 18*a* in the side edge parts in the heat application roller 19 is changed to increase the amount of heat generation. For example, the resistance value of the filament 18*a*1, 18*a*-4 is larger than the filament 18*a*2, 18*a*3 (FIGS. 7A-7B).

Operations in the image forming apparatus and fuser control device are described below (1) to (3).

(1) Operations in the image forming apparatus are described at first.

As shown in FIG. 1, when an order for printing is accepted, the printing control unit 10 drives the LED print head 4, the power supply 12, the motor power supply 13, and the heater power supply 15.

Next, the printing control unit 10 drives the sheet carrying motor 14*a*, and the hopping roller 2 and the sheet carrying paths 3*a*, 3*b* carry the sheet 1 to the toner image developing unit 5 according to timings for the image forming. The LED print head 4 emits a light to the toner image developing unit 5 based on a printing information, and the toner image developing unit 5 forms the toner image on the sheet 1 based on the emitted light by the LED print head 4 (FIG. 2). Next, the sheet 1 is carried to the fuser device 6 through the sheet carrying paths 3*b*, 3*c*. The fuser device 6 fuses the toner image to the sheet 1 with heat and pressure, and the sheet 1 is carried through the sheet carrying paths 3*c*, 3*d* to eject it.

(2) Operations in the fuser control device of comparative example are described at first.

Figure 8A:
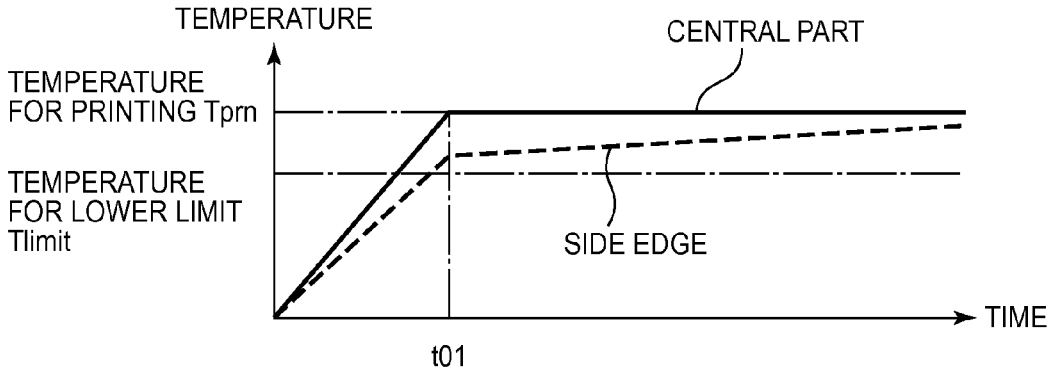
FIGS. 8A and 8B are schematic views showing a control system and process of a temperature of a fuser device according to a comparative example.
Figure 8B:
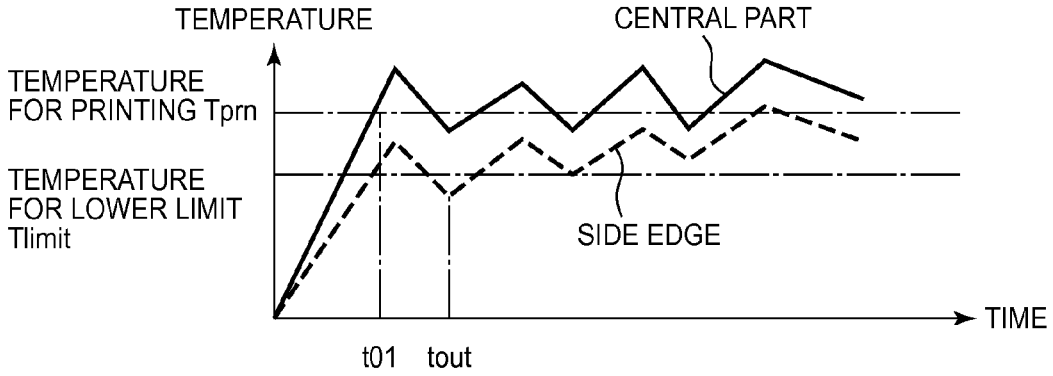

FIG. 8A is a schematic view showing a process of a temperature of the fuser device 6 when the heat capacity of heat application roller 19 is large, and FIG. 8B is a schematic view showing a process of a temperature of the fuser device 6 when the heat capacity of heat application roller 19 is small.

Presently, it is typical to utilize a heat application roller 19 that has a small heat capacity because an energy to heat a surface of the heat application roller 19 for the printing needs to be small in order to reduce energy usage.

When the heat capacity of the heat application roller 19 is large, the amount of heat that is generated by the fuser heater 6*a* accumulates once inside the heat application roller 19 (FIG. 8A). Thus, when the sheets reaches the fuser device 6 and contacts the heat application roller 19, the accumulated amount of heat transfers to the sheet 1 in a near side of the surface of the heat application roller 19.

As shown in FIG. 7B, the amount of heat generation in the both side edge parts is larger than the amount of heat generation in the central part of the heat application roller 19. Thus, the temperature of the both side edge parts little by little approaches to the temperature of the central part while the printing keeps going (FIG. 8A). In the meantime, the temperature of the both side edge parts increases moderately. When a temperature of the fuser device 6 is over a temperature of the lower limit (Tlimit) at the time t01 that is at the beginning of the printing, the temperature of the fuser device 6 has not been under the Tlimit (FIG. 8A).

On the other hand, as shown in FIG. 8B, when control operation of the heat application roller 19 applies the control operation in FIG. 8A, an increasing speed of the temperature of the heat application roller 19 is faster than an increasing speed of the temperature of the heat application roller 19 in FIG. 8A, because the heat capacity of the heat application roller 19 is small. The control operation is to change the situation of the switch 15*a* to OFF when the temperature of the fuser device 6 approaches a set temperature, and to change the situation of the switch 15*a* to ON when the temperature of the fuser device 6 falls below the set temperature. Besides, the accumulated amount of heat of the fuser device 6 is small, so the temperature of the fuser device 6 decreases quickly when the situation of the switch 15*a* changes to OFF. When the printing speed is faster and faster, the number of sheets 1 which go through the fuser device 6 rises per unit time. Thus, the amount of heat that the sheet 1 obtains from the heat application roller 19 per unit time increases, and the temperature of the fuser device 6 decreases more quickly when the situation of the switch 15*a* changes to OFF. A range of the temperature of the fuser device 6 in FIG. 8B is larger than a range in FIG. 8A, because the control operation has a problem, for example, the timing to change the situation of the switch 15*a* to ON is late in the control operation.

There is a way to improve the problem of the control operation, for example, the way is to change the situation of the switch 15*a* more frequently. But, the way has an adverse effect that the other electrical parts obtain noise, for example the flicker noise. On the other hand, there is a way to set a target temperature (Tprn) to a high temperature that a deficiency in fusing does not happen. But, the consumed power required is greater.

(3) To improve the problem in the comparative example, a control operation by a fuser control device in the first embodiment is described below.

When an order for printing is accepted, the heat application roller 19 rotates. Next, the heat application control unit 11 determines whether a surface temperature of the heat application roller 19 is within limits of a set temperature for printing based on the results of detecting for the contactless thermistor 16 and the compensating thermistor 17. When the surface temperature of the heat application roller 19 is within limits of a set temperature, the sheet 1 starts being carried to the fuser device 6. The limits of a set temperature is a range of temperature to normally fix a toner to the sheet 1, and has a temperature of the lower limit (Tlimit) and a temperature of the upper limit (T2). The Tlimit is, for example, 160 degrees C., and the T2 is, for example, 200 degrees C.

When the surface temperature of the heat application roller 19 is higher than the T2, the heat application control unit 11 stops supplying the power for the fuser heater 6*a* to decrease the surface temperature (cool-down). On the other hand, when the surface temperature of the heat application roller 19 is lower than the Tlimit, the heat application control unit 11 starts supplying power for the fuser heater 6*a* to increase the surface temperature (warm-up).

The control operation for the temperature of the fuser device 6 is described below with reference to FIG. 9. The control operation is to control the temperature of the fuser device 6 with changing the targeting temperature based on the second detecting temperature (Tamb) and the amount of heat by the heat application roller 19 in a controlled manner.

The printing control unit 10 monitors whether there is an order for the printing (S1). When the order for the printing is detected (S1, Y), the printing control unit 10 informs a starting control for the temperature of the fuser device 6 to the heat application control unit 11. Next, the heat application control unit 11 detects the second detecting temperature Tamb from the contactless thermistor 16 (S2). The printing control unit 10 transfers the order for the printing to the heat application control unit 11. The heat application control unit 11 determines and sets a temperature for the printing (Tprn) based on the order for the printing (S2).

The heat application control unit 11 controls the driving for the fuser device 6 so that the surface temperature of the heat application roller 19 could meet the Tprn. The Tprn may be appropriate temperatures depending on printing conditions, and the information about the Tprn may be stored in the memory (not shown) that is included in the printing control unit 10. The information about the Tprn may be calculated in advance.

The heat application control unit 11 compares the second detecting temperature Tamb with the switching temperature Tcold1 (S3). The switching temperature Tcold1 is elaborated afterward. When the Tamb is equal to or higher than the Tcold1 (S3, N), a targeting temperature (Tsp) as the temperature for the printing Tprn is not corrected. Because, the temperature of the fuser device 6 approaches to a high enough level to fuse a toner. When the Tamb is lower than the Tcold1 (S3, Y), the heat application control unit 11 corrects the Tsp (S4). Because, the temperature of the fuser device 6 is too low to fuse a toner. The correction is to calculate a formula "Tsp=Tprn+delta T." (S4) For example, when the Tprn is 180 degree C. and the delta T is 20 degree C., the Tsp is 200 degree C. as a result of the correction.

The targeting temperature Tsp is corrected based on the second detecting temperature Tamb. Because, when the Tamp is low, the temperature of the holding member 21 is determined low. And, when the temperature of the holding member 21 is low, the amount of heat that in the both side edge of the heat application roller 19 transfers to the house 8. Thus, the temperature of the both side edge decreases. To prevent the decreasing of the temperature of the both side edge, the Tsp is set to a high targeting temperature Tsp.

Figure 10A:
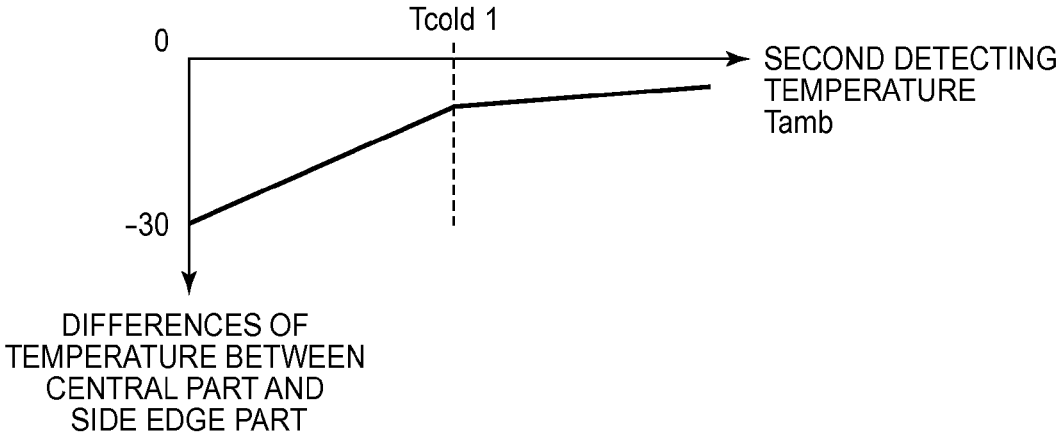
FIG. 10A is a signature for a relation between second detecting temperature Tamb and differences of a temperature between a central part and side edge parts in the heat application roller from FIG. 5.
Figure 10B:
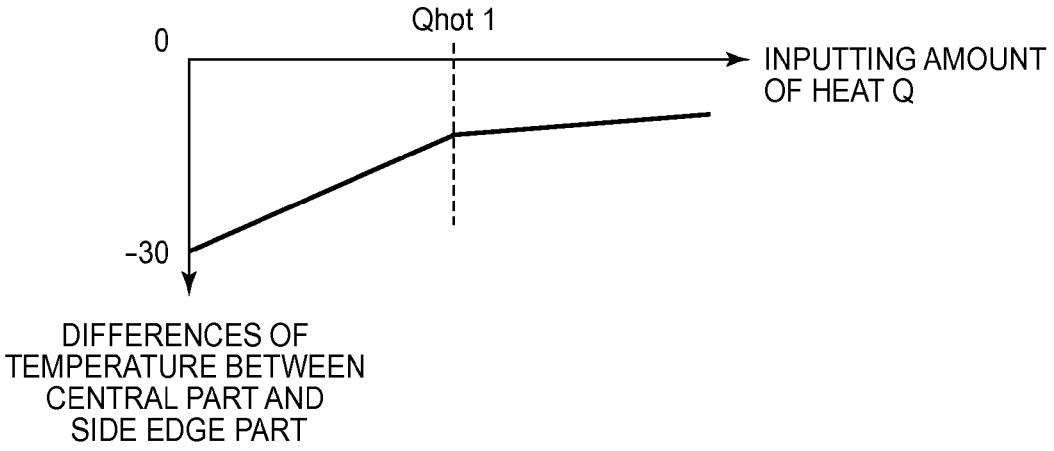
FIG. 10B is a signature for a relation between inputting heat quantity Q and differences of a temperature between a central part and side edge parts in the heat application roller from FIG. 5.

In FIG. 10A, the horizontal axis means the second detecting temperature Tamb, and the vertical axis means differences of a temperature between a central part and side edge parts in the heat application roller 19. In FIG. 10B, the horizontal axis means amount of heat (Q) that the halogen heater 18 provides to the heat application roller 19 during the printing, and the vertical axis means differences of a temperature between the central part and the side edge part of the heat application roller 19. The amount of heat (Q) is an energy in joules.

As shown in FIG. 10A, the second detecting temperature Tamb increases with decreasing the difference of the temperature between the central part and the side edge parts of the heat application roller 19. Because, when the second detecting temperature Tamb is high, the amount of heat that transfers from the side edge parts of the heat application roller 19 decreases.

As shown in FIG. 10B, the amount of heat (Q) increases with decreasing the difference of the temperature between the central part and the side edge parts of the heat application roller 19. The amount of heat generation in the side edge parts compared with the center part is large is considered as one of the reason. When the amount of heat (Q) increases, the large amount of heat in the side edge parts transfers to the holding member 21. Thus, the temperature of the holding member 21 increases. After that, the amount of heat transferring to the holding member 21 in the side edge parts decreases, and as a result, the temperature of the side edge parts increases. Also, a large amount of heat is provided to the side edge parts of the heat application roller 19, and the temperature of the side edge parts increases in a synergistic manner with the decreasing of amount of heat in the side edge parts.

The switching temperature Tcold1 is decided when the difference of the temperature between the central part and the side edge parts in the heat application roller 19 is as small as the difference needs to be.

When the Tamb is lower than the Tcold1, the temperature of the heat application roller 19 as a whole is not uniform, in other words, an amount of heat from the side edge parts in the heat application roller 19 lacks. When the Q is lower than the Qhot1, the same goes for the amount of heat from the side edge parts in the heat application roller 19 that lacks.

The switching temperature Tcold1 and the amount of heat Qhot1 may be calculated as a result of an experiment. The Tcold1 may be, for example, 80 degree C., and the amount of heat Qhot1 is, for example, 18 kJ.

Also, the amount of heat Qhot1 may be calculated depending on a number of printed sheet or a time of the printing. For example, when a number of printed sheet is over 30 sheets, the value of the Tamb is decided as the Qhot1 at the time. And, when a time of the printing is over 30 seconds, the value of the Tamb is decided as the Qhot1 at the time.

Next, as shown in FIG. 9, the printing control unit 10 starts the printing process when the temperature of the fuser device 6 is within the range to print (S5). The heat application control unit 11 determines whether the fuser heater 6*a* is ON or OFF (S6). When the fuser heater 6*a* is ON, the heat application control unit 11 calculates the amount of heat Q from the heater power supply 15 (S7).

The controlling of the fuser heater 6*a* is to generate heat at 100% rate or to generate no heat (0%) (FIG. 6B). In other words, the fuser heater 6*a* works at full capacity, or does not work. Thus, when the working time of the fuser heater 6*a* at 100% rate is calculated, the amount of heat Q is calculated. The working time is second, and the amount of heat of the fuser heater 6*a* at 100% per unit time is, for example, 1200 W.

Next, the heat application control unit 11 compares the current amount of heat Q that has been calculated with the amount of heat Qhot1 (S8). When the Q is larger than the Qhot1 (Y, S8), next S10 is processed (S10). When the Q is equal to or smaller than the Qhot1 (N, S8), next S9 is processed (S9). The heat application control unit 11 compares the second detecting temperature (Tamb) with the switching temperature (Tcold1) (S9). When the Tamb is equal to or larger than the Tcold1 (N, S9), next S10 is processed (S10). When the Tamb is smaller than the Tcold1 (Y, S9), next S11 is processed (S11).

In S10, the correcting process for the targeting temperature (Tsp) is released, and the Tprn is set to the Tsp.

When the printing control unit 10 does not receive a notification that the printing process has finished (N, S11), next S6 is processed. When the printing control unit 10 receives a notification that the printing process has finished (Y, S11), the control operation for the temperature is over.

Figures 11A, 11B, 11C:
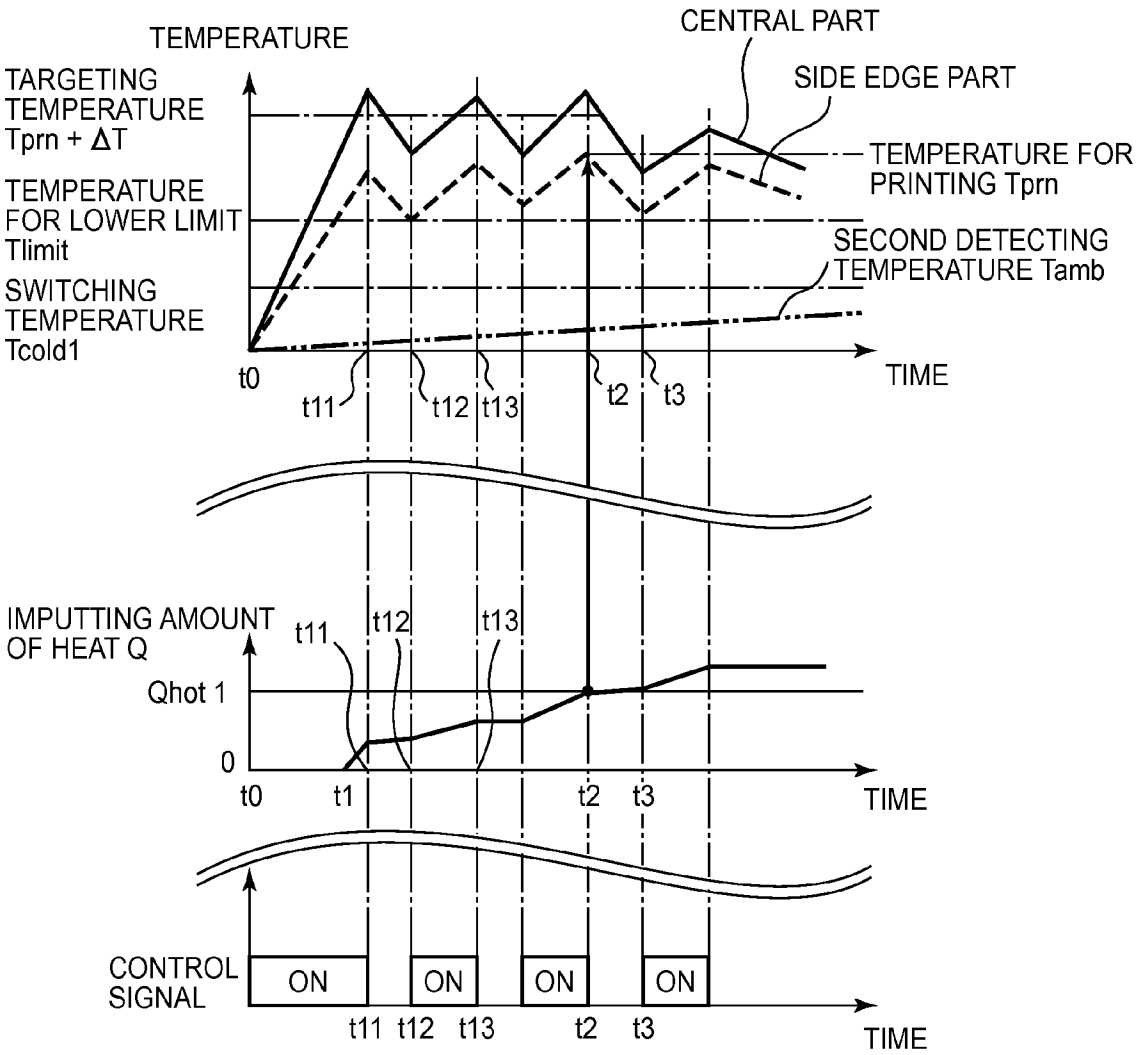
FIGS. 11A-11C and 12A-12C are schematic views showing a control system and process of a temperature of the fuser device from FIG. 5.

FIG. 11A is a schematic view showing a process of temperature of the central part and side edge parts in the heat application roller 19 after the control operation for the temperature starts from the room temperature. FIG. 11B is a schematic view showing a process of the amount of heat and a control signal for the fuser heater 6*a*.

All of the temperatures are same as a room temperature at time t0 (FIG. 11A). The heat application control unit 11 starts the control operation for the temperature after the printing control unit 10 receives an order for the printing.

The heat application control unit 11 corrects the targeting temperature (Tsp) when the Tamb is smaller than the Tcold1.

The heat application control unit 11 corrects the Tsp to a targeting temperature (Tprn+delta T) that is higher than the temperature for the printing (Tprn). When the surface temperature (Tc) of the heat application roller 19 approaches to the targeting temperature, the printing control unit 10 starts the printing process at time t1 (FIG. 11A).

The heat application control unit 11 controls the heater power supply 15 for the driving of the heat application roller 19, and controls the temperature of the central part in the heat application roller 19 to approach to the targeting temperature. Besides, the heat application control unit 11 calculates the amount of heat (Q). When the Q is larger than the Qhot1 and the Tamb is equal to or larger than the Tcold1, the correcting process for the targeting temperature (Tsp) is released, and the Tprn is set to the Tsp. Thus, the temperature of the heat application roller 19 keeps the range of the temperature that is ready to print.

At time t3, the difference of the temperature between the central part and the side edge parts in the heat application roller 19 is sufficiently small (FIG. 11A). Thus, the temperature of the side edge parts is not ever lower than the temperature of the lower limit (Tlimit), and the deficiency in fusing does not happen.

Figure 12A:
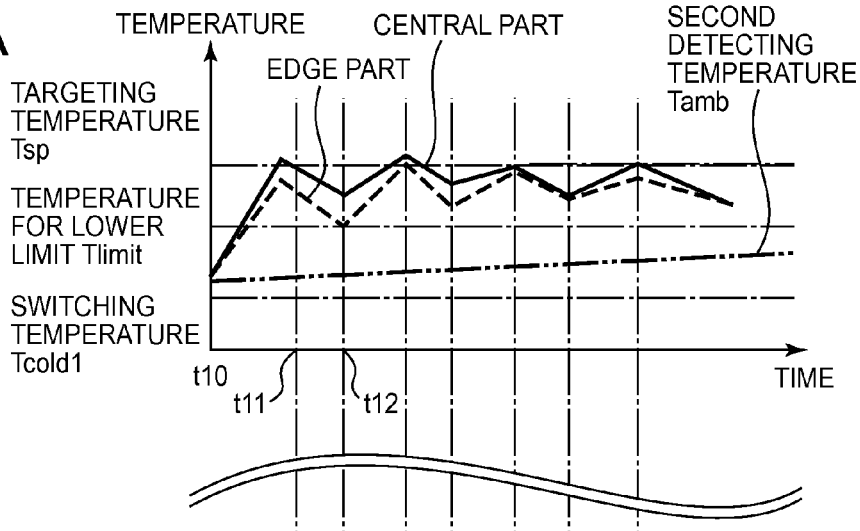
Figure 12B:
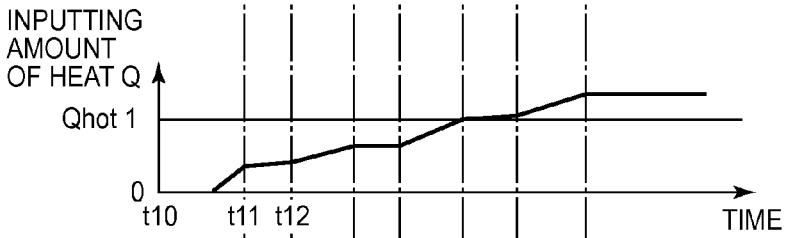
Figure 12C:
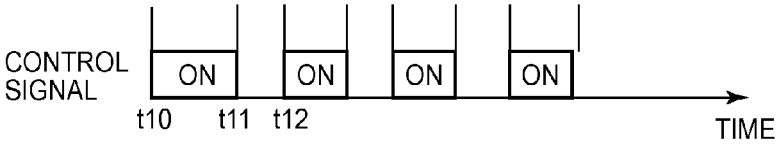

FIG. 12A is a schematic view showing a process of temperature of the central part and side edge parts in the heat application roller 19 after the control operation for the temperature starts at the condition that the fuser device 6 is warm. FIG. 12B is a schematic view showing a process of the amount of heat. FIG. 24C is a schematic view showing a process of a control signal for the fuser heater 6*a*.

As shown in FIG. 12A, the second detecting temperature (Tamb) is higher than the switching temperature (Tcold1) at time t10, so the heat application control unit 11 does not correct the targeting temperature (Tsp). The difference of the temperature between the central part and the side edge parts in the heat application roller 19 is sufficiently small. Thus, a temperature of the side edge parts is not below the temperature of the lower limit (Tlimit) at the time t11 and t12, and the deficiency in fusing does not occur.

Figure 13:
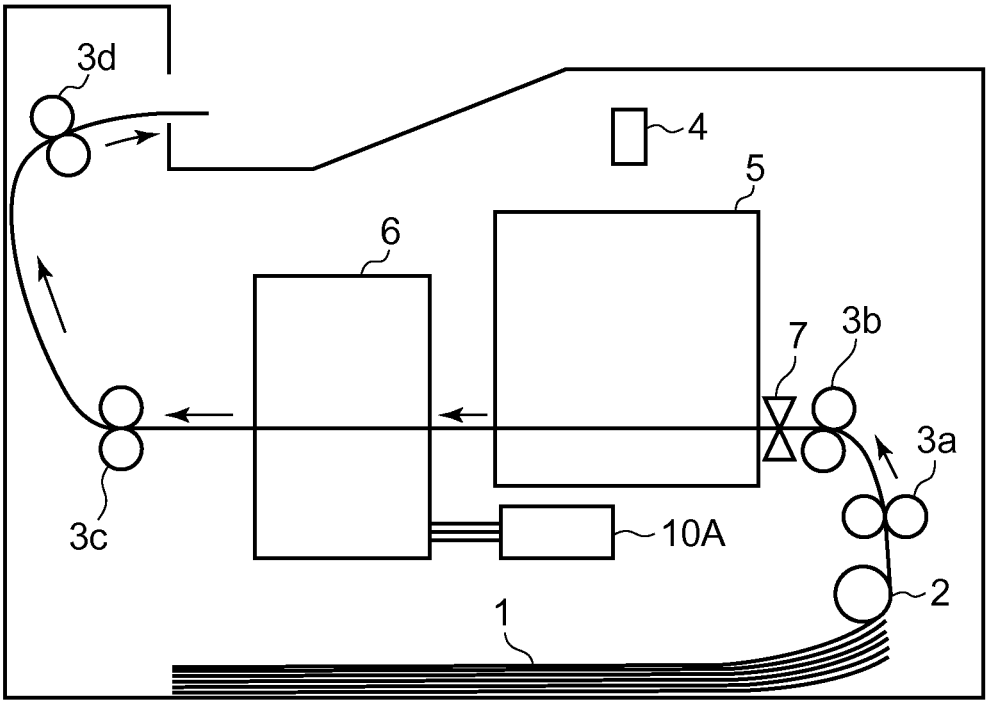
FIG. 13 is a schematic sectional view showing an image forming apparatus according to another exemplary embodiment.

Referring to FIG. 13, an image forming apparatus in a variation is described below. The image forming apparatus includes a sheet monitoring sensor 7 in addition to the configuration of the image forming apparatus in the first embodiment. And, the printing control unit 10 is replaced by the printing control unit 10A. The sheet monitoring sensor 7 is arranged between the sheet carrying path 3*b* and the toner image developing unit 5, and the sheet monitoring sensor 7 detects a position or a presence of the sheet 1 and transfers a result of the detecting to the printing control unit 10A. For example, when the sheet monitoring sensor 7 detects a presence of the sheet 1 (ON), the sheet monitoring sensor 7 transfers the result indicated ON to the printing control unit 10A. When the sheet monitoring sensor 7 detects no presence of the sheet 1 (OFF), the sheet monitoring sensor 7 transfers the result indicated OFF to the printing control unit 10A.

The printing control unit 10A includes a heat application control unit 11A (FIG. 14), and the printing control unit 10A has a function described below in addition to the function of the printing control unit 10 in FIGS. 1, 2. The printing control unit 10A calculates a number of the sheet 1 for printing based on the result of the detecting from the sheet monitoring sensor 7, and the printing control unit 10A orders the heat application control unit 11A to supply the power for the fuser heater 6*a* to generate the heat according to the number of printed sheet.

Figure 14:
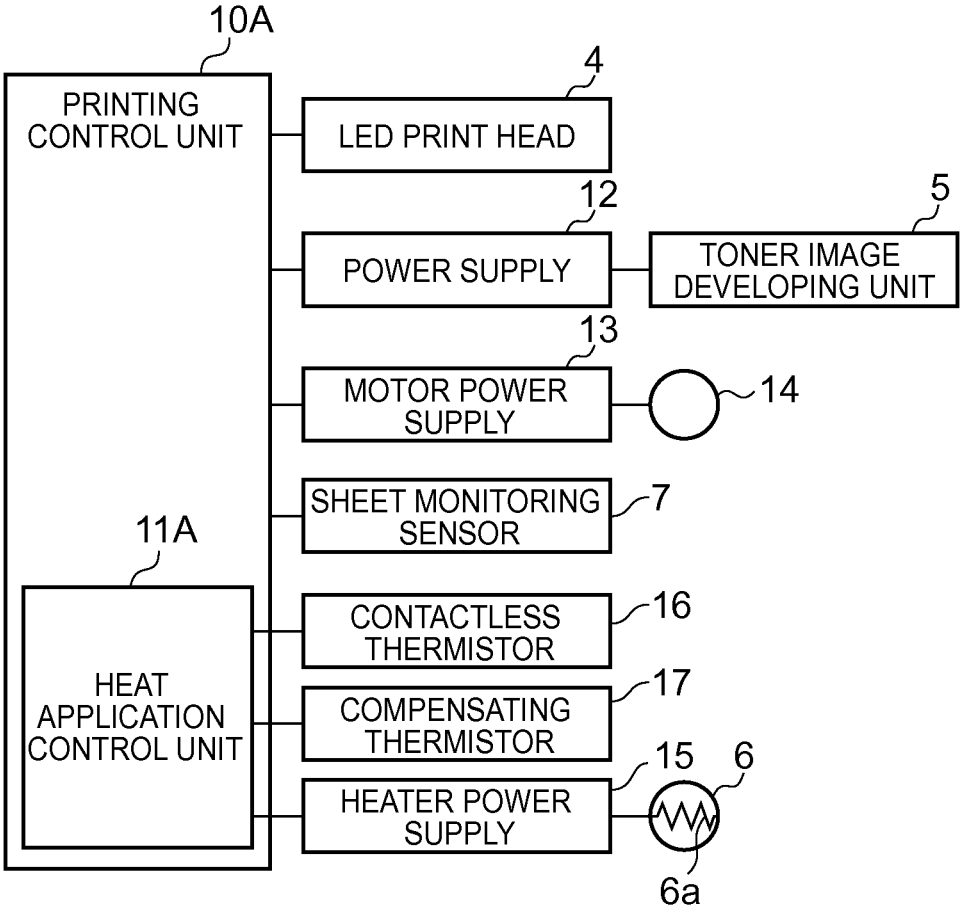
FIG. 14 is a block diagram showing the image forming apparatus in FIG. 13.

As shown in FIG. 14, the printing control unit 10A connects the LED print head 4, the power supply 12 that applies a voltage to the toner image developing unit 5, the motor power supply 13 that supplies a power to the sheet carrying motor 14, the heater power supply 15, the contactless thermistor 16, the compensating thermistor 17, and the sheet monitoring sensor 7.

The heat application control unit 11A has a function described below in addition to the function of the heat application control unit 11 in FIG. 1. The heat application control unit 11A controls the heater power supply 15 based on the order from the printing control unit 10A. The heat application control unit 11A connects the heater power supply 15, the contactless thermistor 16, and the compensating thermistor 17.

Figure 15:
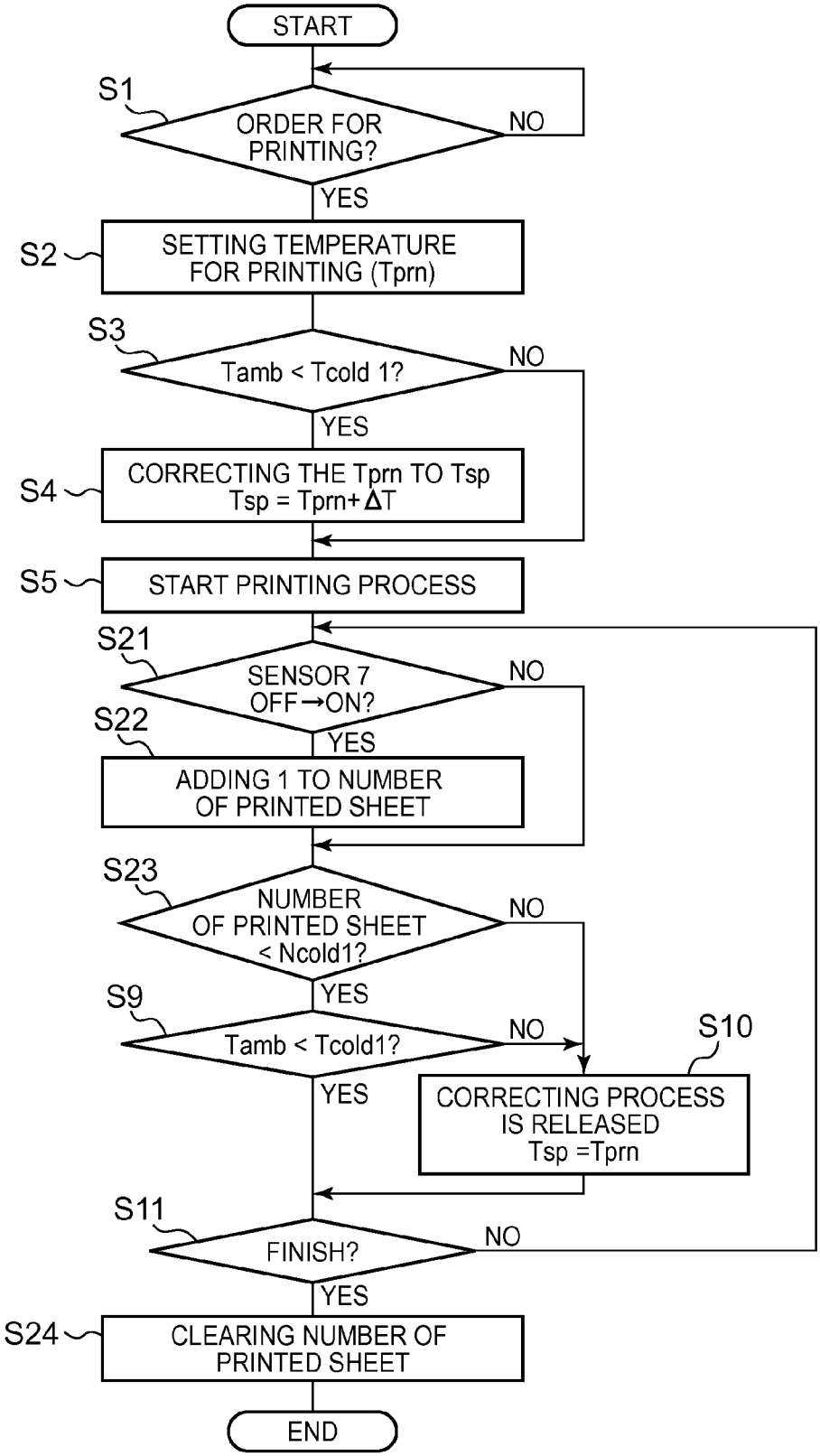
FIG. 15 is a flowchart showing a control operation for a temperature of the fuser device from FIG. 14.

Referring to FIG. 15, a control operation for a temperature in the variation of the first embodiment is described below. The S6-S8 in FIG. 9 is replaced by S21-S24 (FIG. 15). Common processes between the control operation in FIGS. 9 and 15 may be described by the same reference numbers.

When the control operation starts, the S1-S5 are processed.

The printing control unit 10A detects a change in state to ON from OFF based on the result that the sheet monitoring sensor 7 transfers (S21). When the printing control unit 10A detects that the ON state (Y, S21), S22 is processed as described further below. When the printing control unit 10A detects the OFF (N, S21), S23 is processed as described further below.

Next, the printing control unit 10A adds 1 to the number of printed sheet (S22).

Next, the heat application control unit 11 compares the number of printed sheet with a set comparing number (Ncold) (S23). When the number of printed sheet is equal to or larger than the Ncold (N, S23), the S10 is proceeded. When the number of printed sheet is smaller than the Ncold (Y, S23), the S9 is proceeded.

The comparing number (Ncold) is a number of printed sheet that is good enough to fuse a toner in accordance with a temperature of the side edge parts in the heat application roller 19 approaches high fully. The Ncold may be predetermined according to an experiment, and the Ncold is, for example, 5.

When a sheet 1 goes through the fuser device 6, the sheet 1 contacts the heat application roller 19. And, a heat that is accumulated in the heat application roller 19 transfers to the sheet 1 that is low temperature. So, the temperature of the heat application roller 19 decreases. The heat application control unit 11A orders the heater power supply 15 to supply a power to the fuser heater 6*a* to make up for the decreasing temperature of the heat application roller 19. The more the number of sheets that goes through the fuser device 6, the more the heat transfers from the heat application roller 19 to the sheet 1. Thus, the supplying power by the heater power supply 15 for the fuser heater 6*a* increases, because a relation between the number of the printed sheet and the heat of the fuser heater 6*a* is proportional. When the number of the printed sheet is found out, the heat application control unit 11A determines whether heat by the fuser heater 6*a* is good enough or not. In other words, when the number of the printed sheet is larger than the comparing number (Ncold), the heat application control unit 11A determines the temperature of the side edge parts in the heat application roller 19 is high enough. And, a deficiency in fusing does not happen even though the targeting temperature (Tsp) decreases.

When the second detecting temperature (Tamb) is equal to or larger than the Tcold1 (N, S9), the heat application control unit 11A releases the correcting process for the targeting temperature (Tprn+delta T) (S10), and the Tprn is set to the Tsp. When the printing control unit 10 does not receive a notification that the printing process has finished (N, S11), next S21 is processed. When the printing control unit 10 receives a notification that the printing process has finished (Y, S11), the control operation for the temperature is over after the number of the printed sheet is clear (S24).

FIG. 16A is a schematic view showing a process of temperature of the central part and side edge parts in the heat application roller 19 after the control operation for the temperature starts from the room temperature. FIG. 16B is a schematic view showing a process of a control signal for the fuser heater 6*a*. FIG. 16C is a schematic view showing a process of a number of printed sheet. FIG. 16D is a schematic view showing a process of the ON signal of the sheet monitoring sensor 7.

While the ON signal of the sheet monitoring sensor 7 exists (FIG. 16B), the temperature of the central part and side edge parts increases (FIG. 16A). On the other hand, while the ON signal of the sheet monitoring sensor 7 does not exist, the temperature of the central part and side edge parts decreases.

One ON signal of the sheet monitoring sensor 7 corresponds to one for the number of printed sheets. For example, when one ON signal of the sheet monitoring sensor 7 is detected at time t31 (FIG. 16D), the number of printed sheet pluses one. And, every ON signal of the sheet monitoring sensor 7 is detected, the number of printed pluses one steadily since the time t31 (FIG. 16C). While the number of printed sheet is below the comparing number (Ncold), the temperature of the heat application roller 19 is controlled based on the targeting temperature (Tsp) or the targeting temperature (Tsp) that has been corrected (Tsp=Tprn+delta T). And, while the number of printed sheet is equal to or larger than the Ncold, the temperature of the heat application roller 19 is controlled based on the targeting temperature (Tsp) that is equal to the temperature for the printing (Tprn).

(1) The control operation is controlled based on the targeting temperature (Tsp) that has been corrected when the second detecting temperature (Tamb) is lower than the switching temperature (Tcold1). Thus, the deficiency in fusing due to lack of heat to the heat application roller 19 may be prevented even though the temperature of the fuser device 6 is fully low.

(2) When a temperature of only the side edge parts in the heat application roller 19 is low, the targeting temperature (Tsp) is corrected to the Tsp=Tprn+delta T. Thus, power consumption is reduced.

(3) The contactless thermistor 16 and the compensating thermistor 17 are used to detect a temperature of the heat application roller 19 in the control operation for temperature of the fuser device 6. The contactless thermistor 16 and the compensating thermistor 17 are installed in the image forming apparatus previously, so new parts do not need to be installed and the costs for new parts may save.

(4) In the variation of the first embodiment, the targeting temperature (Tsp) is corrected based on the number of printed sheets. Thus, it may make the control operation for temperature of the fuser device 6 more easy and simple.

Next, an image forming apparatus in the second embodiment is described below. Common elements of structures between the first embodiment and the second embodiment may be designated by the same reference characters and be described by the same reference numbers.

Figure 17:
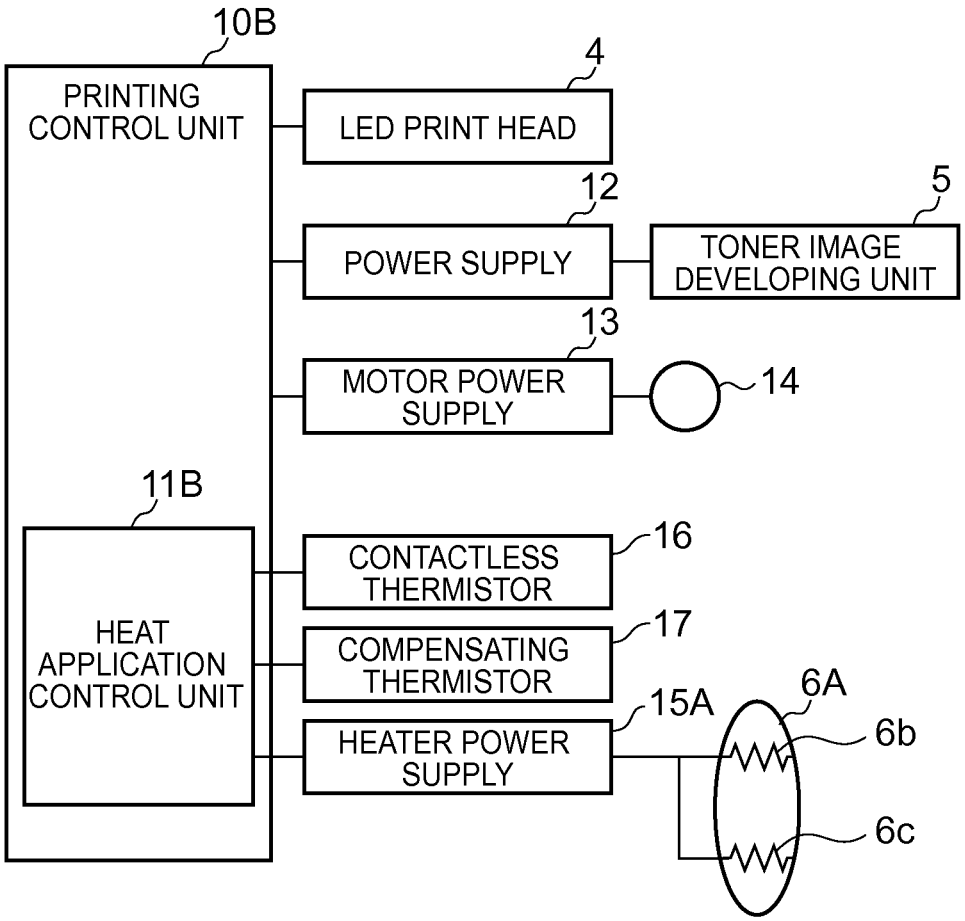
FIG. 17 is a block diagram showing an image forming apparatus according to another exemplary embodiment.

As shown in FIG. 17, the image forming apparatus in the second embodiment includes a printing control unit 10B that has different functions of the printing control unit 10. The printing control unit 10B includes the heat application control unit 11B that has different functions of the heat application control unit 11.

The printing control unit 10B controls the heat application control unit 11B. The printing control unit 10B has a function to control the heat application control unit 11B in addition to the function of the printing control unit 10.

The printing control unit 10 connects the LED print head 4, a power supply 12, and motor power supply 13. The power supply 12 supplies power to the toner image developing unit 5, and the motor power supply 13 supplies power to the sheet carrying motor 14.

The heat application control unit 11B has a function to control the heater power supply 15A based on an order from the printing control unit 10B in addition to the function of the heat application control unit 11. The heater power supply 15A supplies power to a fuser heater 6*b* that is a main-heater and a fuser heater 6*c* that is a sub-heater.

The heat application control unit 11B connects the heater power supply 15A, the contactless thermistor 16, and the compensating thermistor 17.

A fuser control device in the second embodiment may include the heat application control unit 11B, the heater power supply 15A, the fuser heater 6*b*, the fuser heater 6*c*, the fuser device 6A, the contactless thermistor 16, and the compensating thermistor 17. A heat application control device in the second embodiment may include the heat application control unit 11B and the heater power supply 15A.

Figure 18:
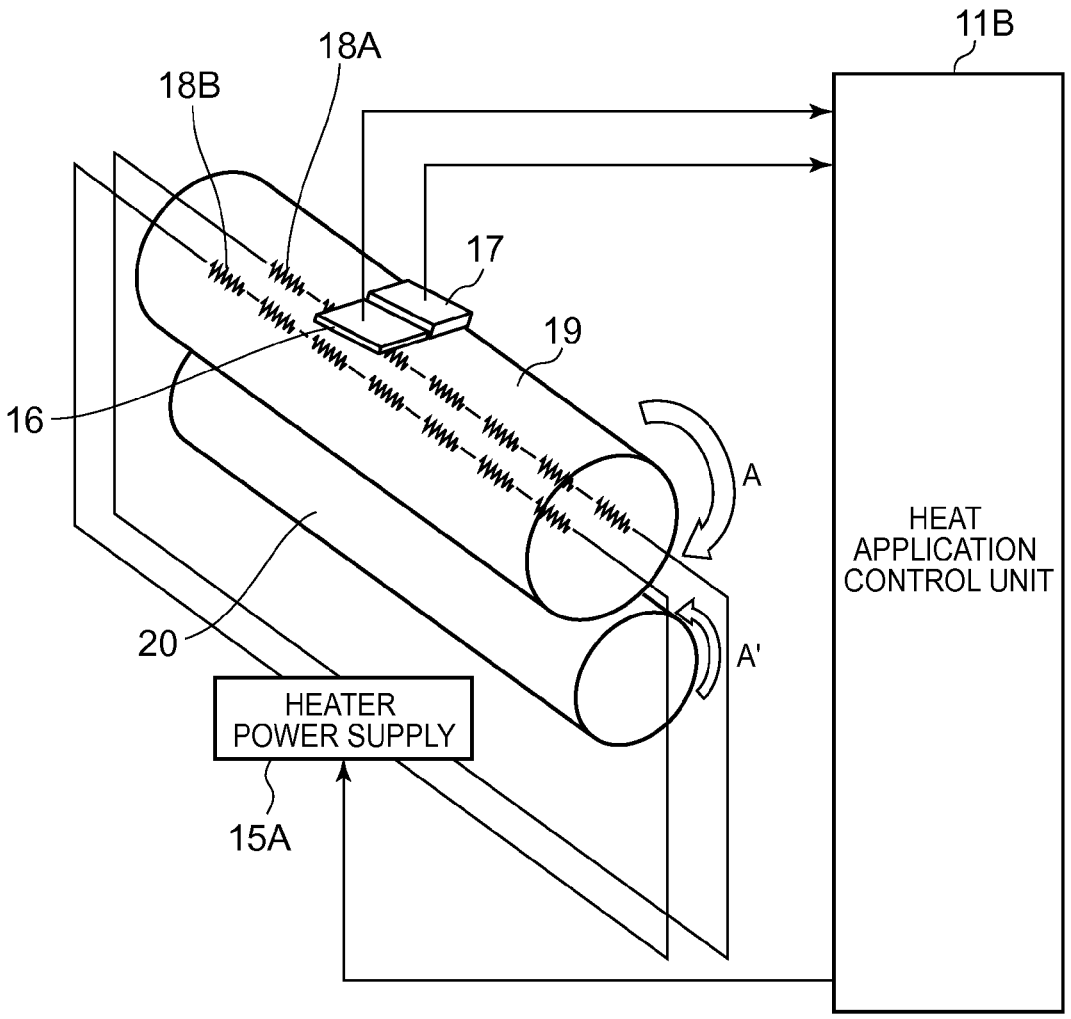
FIG. 18 is a perspective view showing a control system of temperature of a fuser device from FIG. 17.

As shown in FIG. 18, the heat application roller 19 has the halogen heater 18A and the halogen heater 18B built-in. The heater power supply 15A connects a halogen heater 18A and a halogen heater 18B to supply power to them.

Figure 19A:
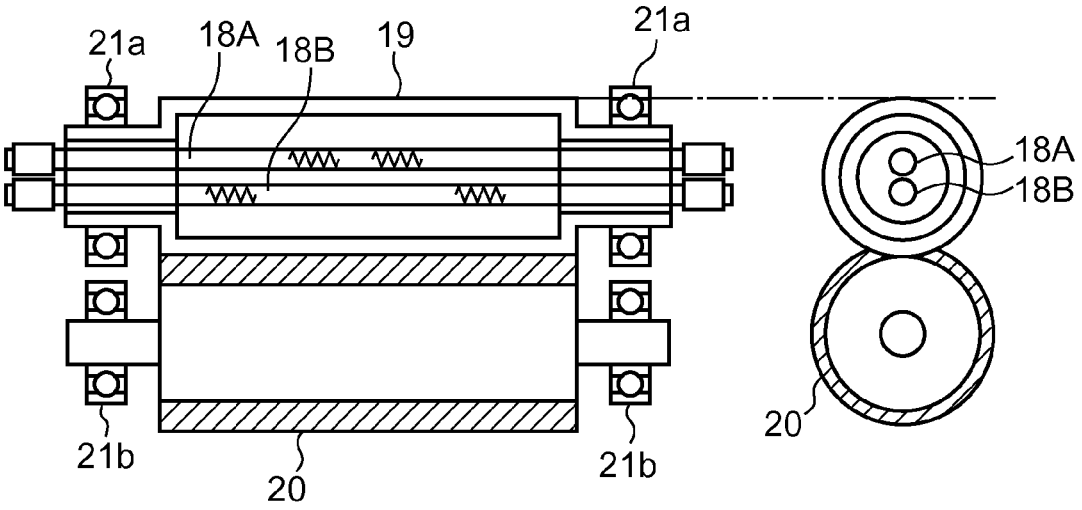
FIG. 19A is a schematic view showing the fuser device.

As shown in FIG. 19A, the halogen heater 18A is arranged above the halogen heater 18B, but the second embodiment is not limited to the constitution, for example, the halogen heater 18B may be arranged above the halogen heater 18A. An amount of heat generation of the halogen heater 18A and the halogen heater 18B is different depending on a part in the heat application roller 19 in the long-side direction (FIG. 19 B). The amount of heat generation of both the halogen heater 18A and the halogen heater 18B may be same to the amount of heat generation of the filament 18*a*.

Figure 19B:
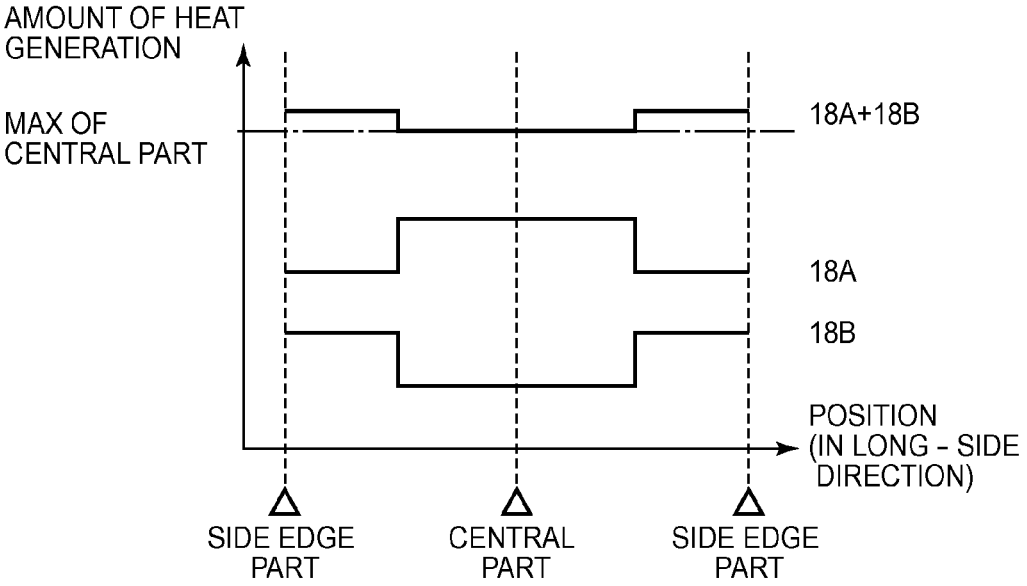
FIG. 19B is a schematic view showing distribution of amount of heat generation.

As shown in FIGS. 19A and 19B, an amount of heat generation of a central part in the halogen heater 18A is larger than side edge parts, so the halogen heater 18A especially heats the central part in the heat application roller 19 rather than the side edge parts. On the other hand, an amount of heat generation of side edge parts in the halogen heater 18B is larger than a central part, so the halogen heater 18B especially heats the side edge parts in the heat application roller 19 rather than the central part. An output power of the halogen heater 18A and the halogen heater 18B is, for example, 600 W.

Figure 20:
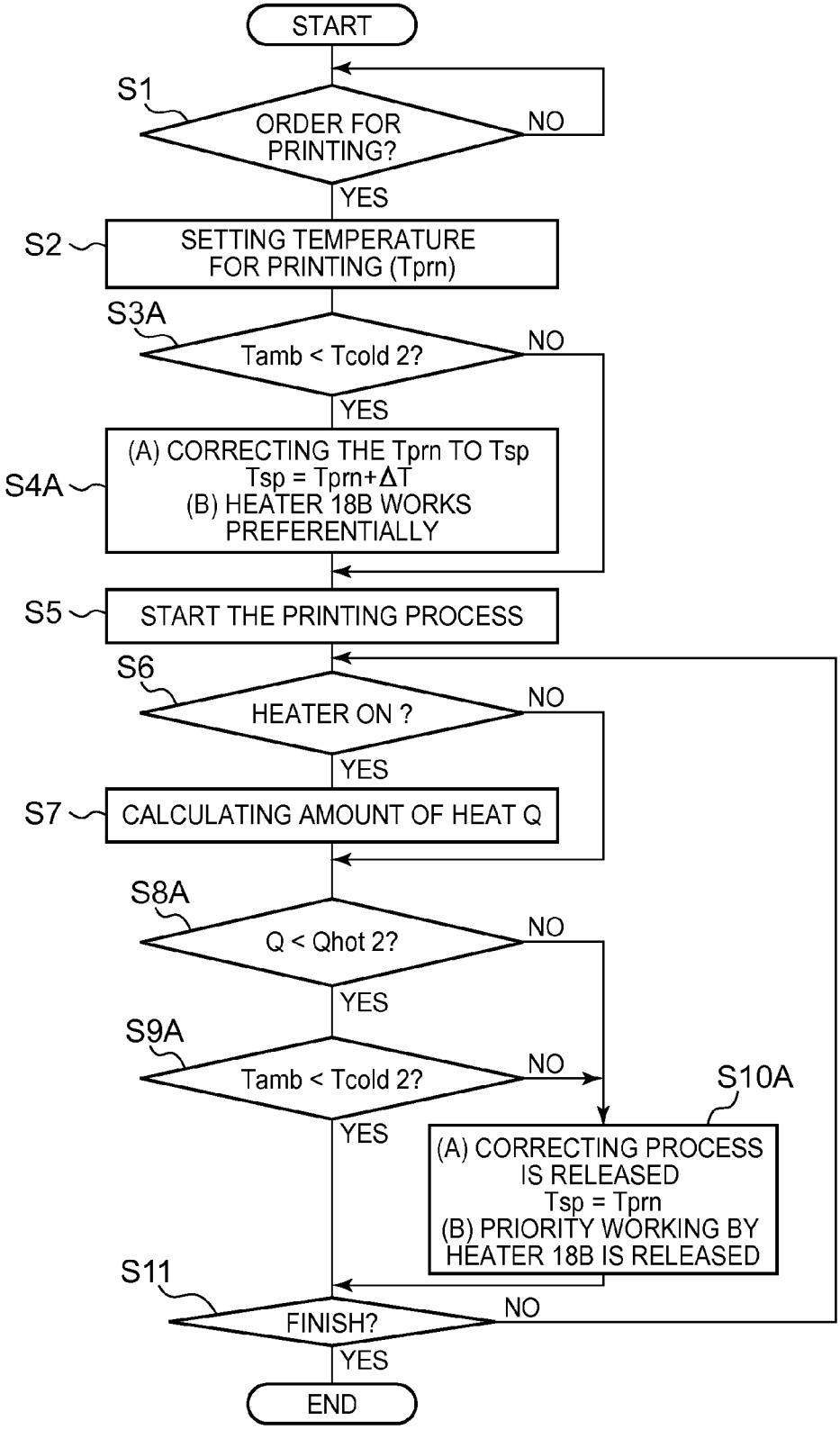
FIG. 20 is a flowchart showing a control operation for a temperature of the fuser device from FIG. 17.

The control operation for temperature in the second embodiment has more processes that have a priority in driving the halogen heater 18B and release the priority in addition to the control operation for temperature in the first embodiment (FIG. 20). The control operation for temperature in the second embodiment is described below.

After the S1 and S2, the heat application control unit 11B compares the second detecting temperature Tamb with the switching temperature Tcold2 (S3A). When the Tamb is lower than the Tcold2 (S3A, Y), next S4A is processed. When the Tamb is equal to or higher than the Tcold2 (S3A, N), S5 is processed.

The heat application control unit 11B corrects the targeting temperature (Tsp) by adding the temperature for the printing (Tprn) to delta T, and drives the halogen heater 18B on a priority basis (S4A).

Figure 21:
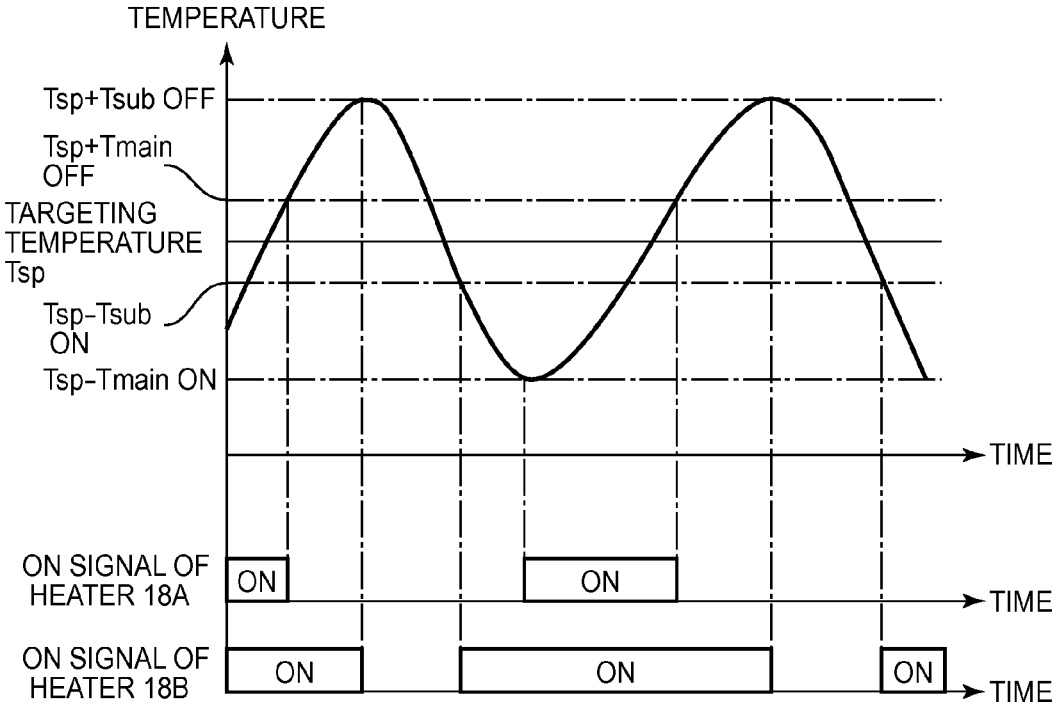
FIG. 21 is a time chart showing a priority control of a sub-halogen heater from FIG. 20.

Referring to FIG. 21, the process to drive the halogen heater 18B on a priority basis (S4A) is described below.

As described above, the amount of heat generation of side edge parts in the halogen heater 18B is larger than a central part. The difference between of the temperature between the central part and the side edge parts in the heat application roller 19 is further small if the halogen heater 18B heats. When the halogen heater 18B heats for a longer time, an amount of heat that needs to print is supplied to the heat application roller 19 in less time. The process to drive the halogen heater 18B (S4A) is described below in more detail.

As shown in FIG. 21, when the surface temperature of the heat application roller 19 is increasing and is below a temperature (Tsp+TmainOFF), ON signals of the halogen heater 18A are generated and the halogen heater 18A turns on. When the surface temperature of the heat application roller 19 is equal to or higher than a temperature (Tsp+TmainOFF), the ON signals are not generated and the halogen heater 18A turns off. When the surface temperature of the heat application roller 19 is decreasing, the ON signals are not generated and the halogen heater 18A turns off.

In a case of the halogen heater 18B, when the surface temperature of the heat application roller 19 keeps or increases and the temperature is below a temperature (Tsp+TsubOFF), ON signals of the halogen heater 18B are generated and the halogen heater 18B turns on. When the surface temperature of the heat application roller 19 decreases and the temperature is between the temperature (Tsp+TsubOFF) and a temperature (Tsp+TsubON), the ON signals are not generated and the halogen heater 18B turns off. When the surface temperature of the heat application roller 19 decreases and the temperature is equal to or lower than a temperature (Tsp+TsubON), the ON signals are generated and the halogen heater 18B turns on.

In the process to drive the halogen heater 18B on a priority basis (S4A), the TmainOFF is below the TsubOFF, and the TmainON is below the TsubON. For example, the TmainOFF is 2 degree C., the TsubOFF is 5 degree C., the TmainON is 5 degree C., and the TsubON is 2 degree C.

When the surface temperature Tc of the heat application roller 19 increases from a low temperature, it approaches the temperature (Tsp+TmainOFF) at the time ta1 before the temperature (Tsp+TsubOFF). Thus, the halogen heater 18A turns off before the halogen heater 18B turns off, and the halogen heater 18B continues heating (FIG. 21).

Next, when the temperature Tc approaches the temperature (Tsp+TsubOFF) at the time ta2, the halogen heater 18B turns off. While both the halogen heater 18A and 18B turns off, the temperature Tc decreases during the time ta2 to ta3. Because, the sheet(s) 1 obtain the heat from the heat application roller 19 when the sheet(s) 1 pass through the fuser device 6A. Next, when the temperature Tc approaches the temperature (Tsp−TsubON) at the time ta3, the halogen heater 18B turns on again, but the he halogen heater 18A continues being off until the time ta4. Next, when the temperature Tc approaches the temperature (Tsp−TmainON) at the time ta4, the halogen heater 18A turns on (FIG. 21).

As described above, a working time of the halogen heater 18B is longer than the halogen heater 18A.

Figures 22A, 22B, 22C:
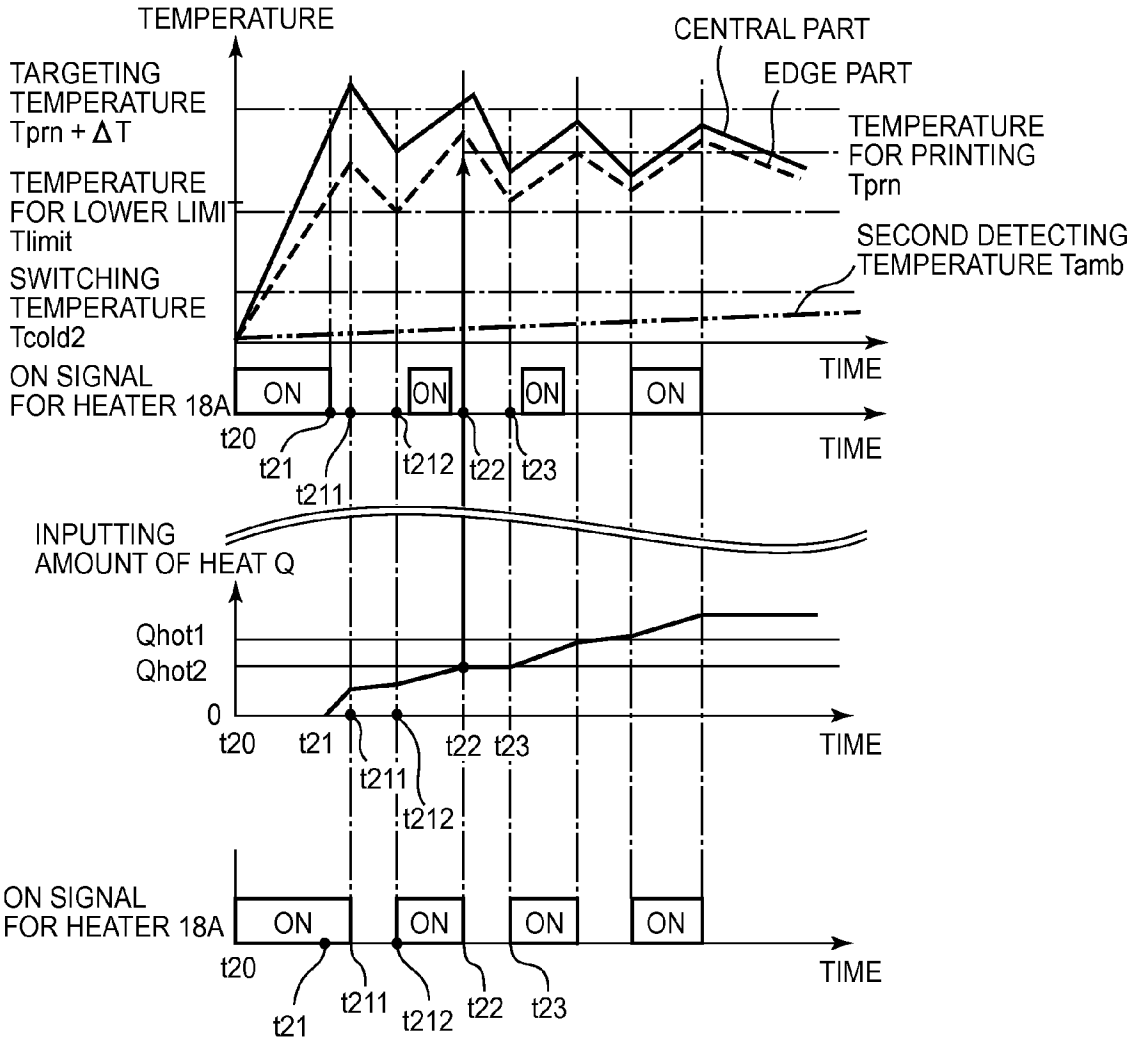
FIGS. 22A-22C are schematic views showing a control system and process of a temperature of the fuser device from FIG. 18.

FIG. 22A is a schematic view showing a process of temperature of the central part and side edge parts in the heat application roller 19 after the control operation for the temperature starts from the room temperature, and showing a process of a control signal for the halogen heater 18A. FIG. 22B is a schematic view showing a process of the amount of heat of the halogen heater 18B. FIG. 22C is a schematic view showing a process of a control signal for the halogen heater 18B.

The all temperatures are same to the room temperature at first (t20). The heat application control unit 11B starts the control operation for the temperature after the printing control unit 10B receives an order for the printing, and the halogen heater 18A and halogen heater 18B start heating.

The heat application control unit 11B corrects the targeting temperature (Tsp) when the Tamb is smaller than the Tcold1. The heat application control unit 11B change the temperature for the printing (Tprn) to a targeting temperature (Tprn+delta T) that is higher than the Tprn. The printing control unit 10B starts the printing process at the time t21 when the temperature of the fuser device 6A approaches over the temperature of the lower limit (Tlimit).

The heat application control unit 11B controls the halogen heater 18A and the halogen heater 18B, and controls the temperature of the central part in the heat application roller 19 to achieve the Tsp. The heat application control unit 11B makes each working time of the halogen heater 18B is a little longer than each one of the halogen heater 18A. Also, the each working time of the halogen heater 18B in S4A is a little longer than the each one of the halogen heater 18 in the first embodiment. For example, the time from t212 to t22 in the working time of the halogen heater 18B (FIG. 22C) is a little longer than the time from t12 to t13 in the working time of the halogen heater 18 (FIG. 11C).

The heat application control unit 11B releases the correcting process for the targeting temperature (Tprn+delta T) when an amount of heat in the halogen heater 18B is over a Qhot2 (FIG. 22B). The heat application control unit 11B changes the targeting temperature (Tprn+delta T) to the temperature for the printing (Tprn) as the targeting temperature (Tsp).

The inputting amount of heat by halogen heater 18A and 18B is good enough at the time 22, and the difference between of the temperature between the central part and the side edge parts in the heat application roller 19 is small. Thus, the deficiency in fusing does not happen. In the second embodiment, the halogen heater 18B works a little long enough rather than the halogen heater 18A and the halogen heater 18 in the first embodiment, so the side edge parts obtain heat fully.

As shown in FIG. 22A, a time until the correcting process is released is the time t22−t20. In the first embodiment, a time until the correcting process is released is the time t2−t0 (FIG. 11A), so the time until the correcting process is released in the second embodiment is shorter than the time in the first embodiment.

Figure 23A:
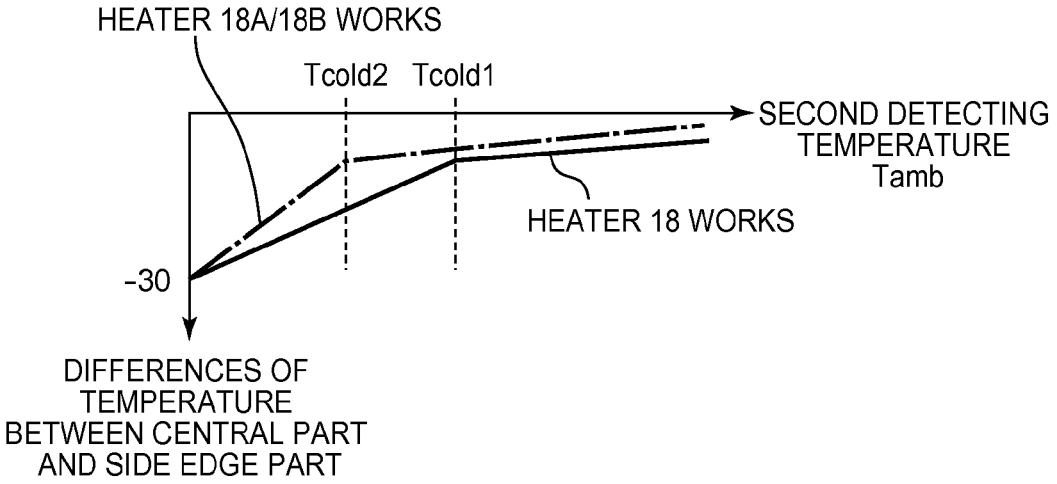
FIG. 23A is a graph illustrating a relationship between a second detecting temperature Tamb and differences of a temperature between a central part and side edge parts in a heat application roller from FIG. 18.
Figure 23B:
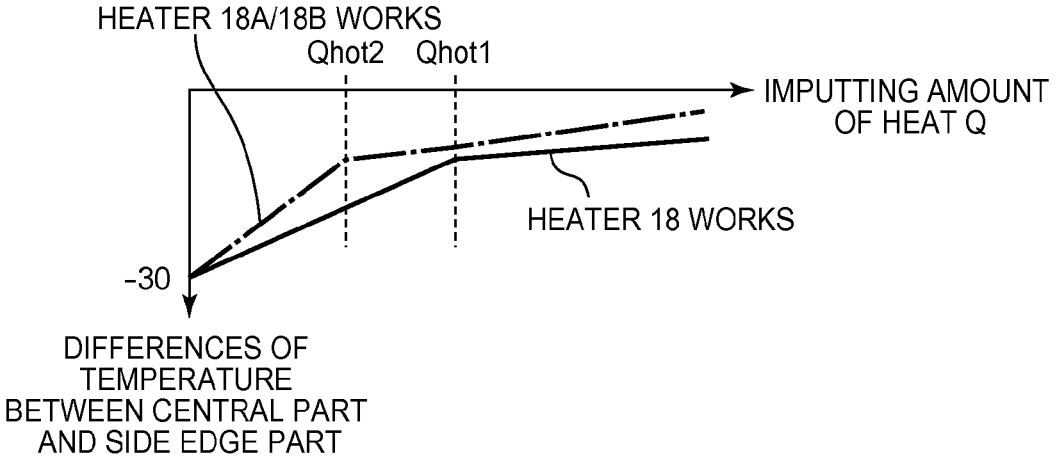
FIG. 23B is a graph illustrating a relationship between an inputting heat quantity Q and differences of a temperature between a central part and side edge parts in the heat application roller from FIG. 18.

As shown in FIGS. 23A and 23B, the switching temperature (Tcold2) is lower than the switching temperature (Tcold1), the amount of heat (Qhot2) is smaller than the amount of heat (Qhot1). The heat application control unit 11B may release the correcting process for the targeting temperature (Tsp) at the amount of heat (Qhot2) that is smaller than the amount of heat (Qhot1).

Figure 24A:
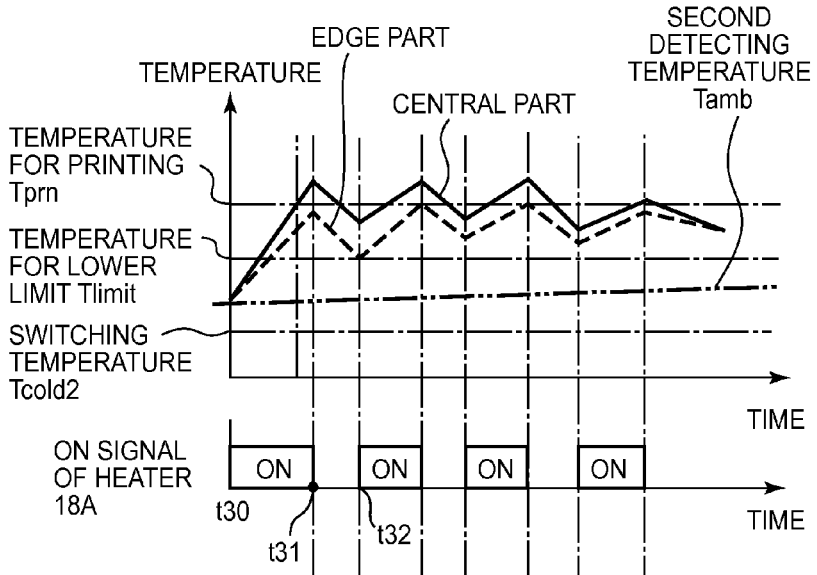
FIGS. 24A-25C are schematic views showing a control system and process of a temperature of the fuser device from FIG. 18.
Figure 24B:
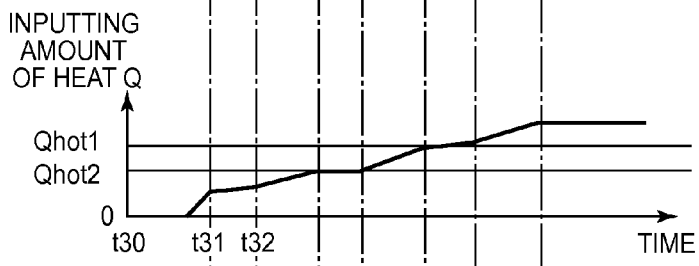
Figure 24C:
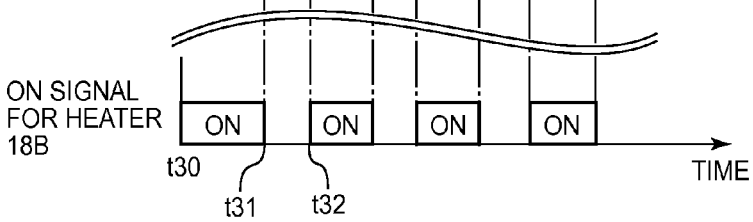

FIG. 24A is a schematic view showing a process of temperature of the central part and side edge parts in the heat application roller 19 after the control operation for the temperature starts at the condition that the fuser device 6A is warm. FIG. 24B is a schematic view showing a process of the amount of heat. FIG. 24C is a schematic view showing a process of a control signal for the fuser heater 6*c*.

When it is a time t30, the second detecting temperature (Tamb) is higher than the switching temperature (Tcold2). Thus, the heat application control unit 11B does not correct the targeting temperature (Tsp), and the Tsp is same to the temperature for the printing (Tprn). As described in the first embodiment (FIGS. 12A-12C), the difference of the temperature between the central part and the side edge parts in the heat application roller 19 is fully small. A temperature of the side edge parts is not below the temperature of the lower limit (Tlimit) even though it is the time t32 (FIG. 24A). So, the deficiency in fusing does not occur.

Figure 25A:
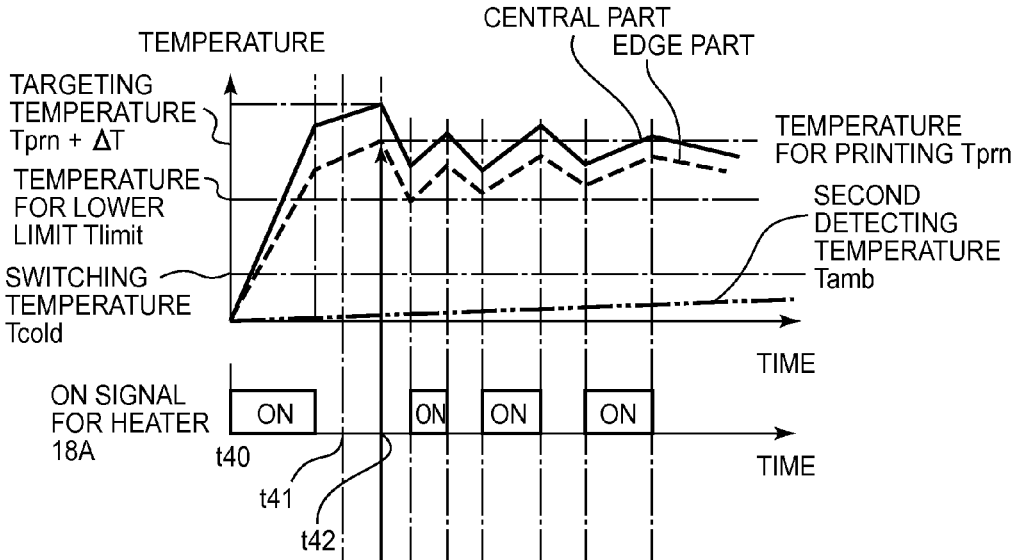
Figure 25B:
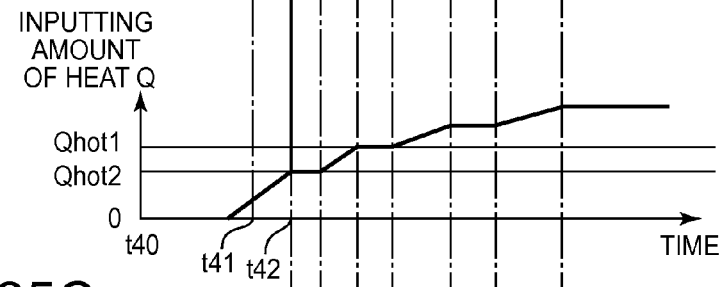
Figure 25C:
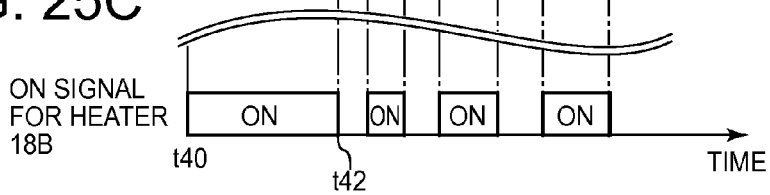

FIG. 25A is a schematic view showing a process of temperature of the central part and side edge parts in the heat application roller 19 after the control operation for the temperature starts from the room temperature, and showing a process of a control signal for the halogen heater 18A in the variation of the second embodiment. FIG. 25B is a schematic view showing a process of the amount of heat of the halogen heater 18B in the variation of the second embodiment. FIG. 25C is a schematic view showing a process of a control signal for the halogen heater 18B in the variation of the second embodiment.

When it is beginning time for printing from a time t40 to t42, the amount of heat of the side edge parts in the heat application roller 19 is insufficient (FIG. 25A). The halogen heater 18A may work under the normal driving control by the heat application control unit 11B, and the halogen heater 18B may work forcibly at the beginning time. The heat application control unit 11B may combine the control process in the variation of the second embodiment with the control process in the second embodiment.

In the second embodiment, the halogen heater 18B drives on the priority basis, so the side edge parts in the heat application roller 19 may shortly obtain heat for the printing.

(1) The heat application control unit 11, 11A, and 11B performs the control operation for temperature of the heat application roller 19 based on the second detecting temperature (Tamb) and the inputting amount of heat (Q), or the second detecting temperature (Tamb) and the number of printed sheet(s). However, the heat application control unit 11, 11A, and 11B may perform the control operation based on the second detecting temperature (Tamb) and a printing duration time. The printing duration time may be measured by a timer that is included in the heat application control unit 11, 11A, and 11B.

(2) The fuser heater 6*a*, 6*b*, and 6*c* are the halogen heater 18, 18A, and 18B. However, the fuser heater 6*a*, 6*b*, and 6*c* may be a sheet heater that includes resistive element(s). The heat application roller 19 has the halogen heater 18, 18A, and 18B built-in. However, the halogen heater 18, 18A, and 18B may be arranged around the heat application roller 19 so as to contact the heat application roller 19.

(3) The compensating thermistor 17 is installed integrally at the same area which the contactless thermistor 16 is installed. However, the compensating thermistor 17 may be installed at the different area.

(4) The detecting temperature unit is the thermistor. However, the detecting temperature unit may be the PTC thermistor (Positive Temperature Coefficient thermistor).

(5) The fuser device 6 adopts the belt-type. However, the fuser device 6 may adopt a roller-type that fuses with the heat application roller 19 and the pressure application roller 20 without the fuser belt 20*a*.

(6) The image forming apparatus is the electrographic system such like a printer. However, the image forming apparatus is not limited to the electrographic system. For example, the image forming apparatus may be a copy device, a fax device, a MFP (Multifunction Printer, Peripheral, or Product).

What is claimed is:

1. A fuser control device, comprising:

a fuser device held by a holding member, the fuser device being configured to fuse a developing image to a printing medium;

a fuser heater that is installed at the holding member, the fuser heater being configured to generate heat for at least a central part and a side part of a heat application roller;

a first temperature detection part configured to detect a temperature of the fuser device and configured to transmit a temperature of the fuser device as a first detecting temperature;

a second temperature detection part configured to detect a temperature of the holding member and configured to transmit a temperature of the holding member as a second detecting temperature; and a heat application control unit configured to control the temperature of the fuser device by changing a targeting temperature for the fuser device based on a controlling condition, wherein after the temperature of the fuser device has approached to the targeting temperature, the heat application control unit determines the controlling condition depending on an amount of heat generated by the fuser heater since a start of a printing process and the second detecting temperature.

2. The fuser control device of claim 1, wherein the fuser device comprises a pressure application roller configured to press the printing medium to the heat application roller.

3. The fuser control device of claim 2, wherein the fuser device comprises a fuser belt that suspends the pressure application roller and contacts the heat application roller.

4. The fuser control device of claim 3, wherein a heat capacity of the fuser belt is smaller than a heat capacity of the holding member.

5. The fuser control device of claim 1, wherein the amount of heat generation is an amount of heat that is transferred to the fuser device during a printing process.

6. The fuser control device of claim 1, further comprising a sheet monitoring sensor configured to count a number of one or more printed sheets that have been printed in succession since a printing starts, wherein the amount of heat generation is calculated based on the number of one or more printed sheets.

7. The fuser control device of claim 1, further comprising a timer configured to time a printing time for one or more printed sheets that have been printed in succession since a printing starts, wherein the amount of heat generation is calculated based on the printing time for one or more printed sheets.

8. The fuser control device of claim 1, wherein a heat capacity of the heat application roller is smaller than a heat capacity of the holding member.

9. The fuser control device of claim 1, wherein the fuser heater is a halogen heater.

10. The fuser control device of claim 1, wherein the fuser heater is a sheet heater.

11. The fuser control device of claim 1, wherein the heat application control unit determines a set condition meets and sets the targeting temperature as the first targeting temperature when the second detecting temperature is lower than a set temperature before a printing process starts.

12. The fuser control device of claim 1, wherein the fuser heater includes a first heater and a second heater, the first heater and the second heater have a central part and a side part, the heat generation of the side part in the first heater is equal to or larger than the heat generation of the central part in the first heater, the heat generation of the side part in the second heater is equal to or smaller than the heat generation of the side part in the first heater, and after the temperature of the fuser device has approached to the targeting temperature, the heat application control unit changes the controlling condition when an amount of the heat generation that is calculated based on time to the first heater working since the printing process starts is equal to or over a predetermined value.

13. The fuser control device of claim 1, wherein working time of the first heater is longer than the second heater.

14. A fuser control device, comprising:

a fuser device that a holding member holds configured to fuse a developing image to a printing medium;

a fuser heater configured to generate heat;

a first temperature detection part configured to detect a temperature of the fuser device and configured to transmit the temperature of the fuser device as a first detecting temperature;

a second temperature detection part configured to detect a temperature of a place that is different from the fuser device and configured to transmit the temperature of the place as a second detecting temperature and;

a heat application control unit configured to control the fuser heater to drive based on the first detecting temperature and a targeting temperature, wherein the heat application control unit sets the targeting temperature as a first targeting temperature before the fuser control device starts fusing when the second detecting temperature is lower than a predetermined temperature, and the heat application control unit changes the first targeting temperature to a second targeting temperature that is lower than the first targeting temperature and the fuser device continues fusing the developing image to the printing medium after the second detecting temperature is higher than a set temperature and the heat application control unit orders the fuser heater to generate heat while a set accumulated time passes when the second detecting temperature is higher than a set temperature and the heat application control unit controls the fuser heater to drive based on the first detecting temperature and the first targeting temperature.

15. The fuser control device of claim 14, wherein the accumulated time is a time that subtracts an elapsed time after the second detecting temperature is higher than a set temperature from a stop-time that the fuser heater has halted.

16. An image forming apparatus, comprising:

a fuser device that a holding member holds configured to fuse a developing image to a printing medium;

a fuser heater that is installed at the holding member configured to generate heat for at least a central part and a side part of a heat application roller;

a first temperature detection part configured to detect a temperature of the fuser device and configured to transmit the temperature of the fuser device as a first detecting temperature;

a second temperature detection part configured to detect a temperature of the holding member and configured to transmit the temperature of the holding member as a second detecting temperature and;

a heat application control unit configured to control the temperature of the fuser device with changing a targeting temperature for the fuser device based on a controlling condition, wherein after the temperature of the fuser device has approached to the targeting temperature, the heat application control unit determines the controlling condition depending on an amount of heat generated by the fuser heater since a start of a printing process and the second detecting temperature.

17. A fuser control device, comprising:

a fuser device that a holding member holds configured to fuse a developing image to a printing medium;

a fuser heater configured to generate heat;

a first temperature detection part configured to detect a temperature of the fuser device and configured to transmit the temperature of the fuser device as a first detecting temperature;

a second temperature detection part configured to detect a temperature of a place that is different from the fuser device and configured to transmit the temperature of the place as a second detecting temperature and;

a heat application control unit configured to control the temperature of the fuser device based on the first detecting temperature and a targeting temperature, wherein the heat application control unit sets the targeting temperature as a first targeting temperature before the fuser control device starts fusing, and when the second detecting temperature is higher than the predetermined temperature, then the heat application control unit controls the temperature of the fuser device based on the first detecting temperature and the first targeting temperature, and wherein when the second detecting temperature is lower than a predetermined temperature, the heat application control unit changes the first targeting temperature to a second targeting temperature that is higher than the first targeting temperature, and wherein when the second detecting temperature is higher than a set temperature the fuser device begins fusing the developing image to the printing medium and the heat application control unit orders the fuser heater to generate a set amount of heat.

* * * * *